US007410742B2

(12) United States Patent
Yamazaki et al.

(10) Patent No.: US 7,410,742 B2
(45) Date of Patent: Aug. 12, 2008

(54) IMAGE FORMING METHOD

(75) Inventors: Hiroshi Yamazaki, Hachioji (JP); Meizo Shirose, Hachioji (JP); Masafumi Uchida, Toyokawa (JP)

(73) Assignee: Konica Minolta Business Technologies, Inc. (JP)

( * ) Notice: Subject to any disclaimer, the term of this patent is extended or adjusted under 35 U.S.C. 154(b) by 476 days.

(21) Appl. No.: 10/982,492

(22) Filed: Nov. 5, 2004

(65) Prior Publication Data

US 2005/0100813 A1 May 12, 2005

(30) Foreign Application Priority Data

Nov. 11, 2003 (JP) ..... 2003-380870
Dec. 1, 2003 (JP) ..... 2003-401333

(51) Int. Cl.
*G03G 15/16* (2006.01)

(52) U.S. Cl. ..... 430/123.5; 430/125.3; 399/266; 399/319

(58) Field of Classification Search ..... 430/123.5, 430/125.3; 399/266, 319
See application file for complete search history.

(56) References Cited

U.S. PATENT DOCUMENTS 2,297,691 A * 10/1942 Carlson ..... 430/125.32
5,708,940 A * 1/1998 Hosaka et al. ..... 399/266
6,475,689 B2 * 11/2002 Yamazaki et al. ..... 430/108.4
6,656,653 B2 * 12/2003 Mitsuhashi et al. .... 430/108.23
2002/0136976 A1 9/2002 Ohmura et al.
2005/0277050 A1 * 12/2005 Yamazaki et al. ..... 430/124

FOREIGN PATENT DOCUMENTS

JP 2001-100546 4/2001
JP 2001-117381 4/2001
JP 2002049164 A * 2/2002
JP 2002-214821 7/2002
JP 2004061587 A * 2/2004

OTHER PUBLICATIONS

English Abstract for JP 2001-100546 Dated Apr. 13, 2001.
English Abstract for JP 2001-117381 dated Apr. 27, 2001.

* cited by examiner

*Primary Examiner*—Christopher RoDee
(74) *Attorney, Agent, or Firm*—Cantor Colburn LLP

(57) ABSTRACT

An image forming method comprising: developing an electrostatic latent image on a latent image carrier with toner to form a toner image, transferring the toner image; and using ultrasonic vibration in the developing step or in the transferring step is disclosed. The toner includes toner particles that contain a releasing agent having a melting point 40-75° C., and has a number-based median diameter D50 of 3.0 to 5.0 μm and a CV value of 12 to 20% in a number-based particle size distribution and/or a mean circularity of 0.975-1.000.

20 Claims, 6 Drawing Sheets

FIG. 6 ( a )
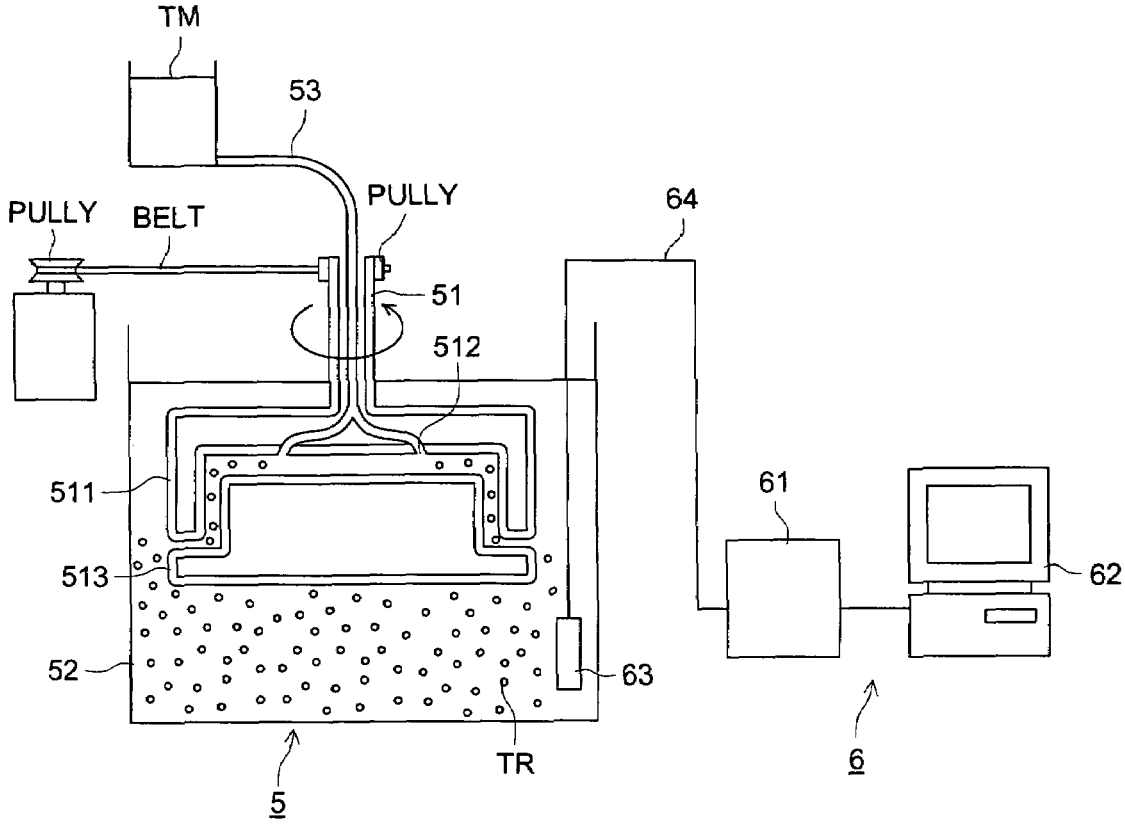
FIG. 6 ( b )
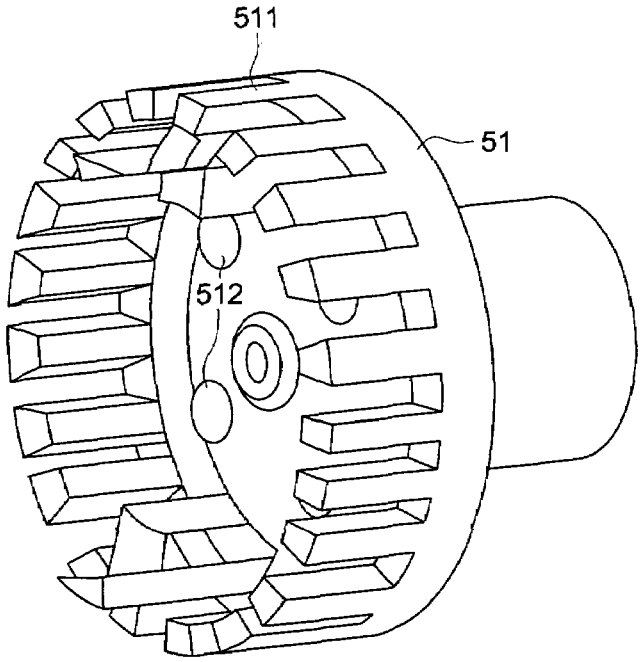

IMAGE FORMING METHOD

BACKGROUND

1. Field of the Invention

The present invention relates to an image forming method which forms a toner image of full color by performing a transfer process using supersonic oscillation, in particular, relates to an image forming method which performs the transfer process by supersonic oscillation using an oilless toner which has specific grain size distribution, or a toner with which the form and the particle size are specified.

2. Related Art

Recently, digital method becomes as the main stream of the image formation by the electrophotographic system. One of such the trends of the technology is a technology of full color image formation. One of the techniques to accelerate the colorization of the toner image is a full color image forming method employing an oil less toner containing a large amount of a parting agent in the toner particle (cf. Japanese Patent Publication Open to Public Inspection, hereinafter referred to as Japanese Patent O.P.I. Publication, No. 2002-214821, paragraph 0049).

In digital image formation, since a dot picture image with a small 1200 dpi (dot number per inch, one inch is 2.54 cm) level may be visualized, when performing image formation, toner so called a small diameter toner whose particle size is several micron orders is used preferably.

Incidentally, in such the image formation employing the small diameter toner, the transfer ability becomes worse on the occasion of transfer of the image formed on the photoreceptor onto an image receiving material such as paper and OHP film. Especially, in an image formation of full color which superimposes the color toners of Y, M, and C so as to form a toner image, the tendency appears significantly, It was difficult to transfer a toner image stably and certainly on a transfer material from a photoreceptor surface or an intermediate transfer member, and also it was difficult to produce a full color picture image which has a good color balance and optical density.

Therefore, techniques have been investigated for surely transferring a toner image onto an image receiving material by applying a physical action to a photoreceptor, as the one measure, there was a method that when transferring a toner image on a transfer material, a supersonic wave was irradiated at a bearing body which bears a toner image, and a toner image was made to transfer efficiently on a transfer material from the bearing body surface in the action of the oscillation by a supersonic wave, (cf. for example, Japanese Patent O.P.I. Publication Nos. 2002-100546, paragraph 0052-0061 and 2001-117381, paragraph 0035 and 0062).

However, the toner transfer methods employing ultrasonic waves disclosed in Japanese Patent O.P.I. Publication Nos. 2002-100546 and 2001-117381 are methods which have been developed for toner which is employed while coating oil on an image receiving material on the occasion of fixing. And although the transfer using supersonic oscillation was tried with an oilless toner having a releasing agent, it did not go well at all in whether fill the performance for which present invention persons ask. When oilless toner was used, the releasing agent was detached from toner particles under the influence of the oscillation by a supersonic wave, and in a fixing process, a transfer material coiled around a fusing roller, and offset was generated.

Moreover, since, as for an oilless toner with which the releasing agent detached itself, an external additive agent also detaches itself with a releasing agent, an adhesion force of the oilless tone with a photoreceptor increases, toner particles with which the transfer rate fell were generated. Therefore, a toner image will become easy to be disordered if the oscillation by a supersonic wave is received, and as a result, there are problems that the color reproduction quality in a full color picture image falls, the toner image of each color do not superimpose well, and picture image scattering is generated.

The invention is accomplished according to the above situation. The object of the invention is to provide an image forming method without occurrence of the winding the image receiving material about the fixing roller and the offset by employing a toner from which the parting agent is not released when the ultrasonic waves are applied.

The invention is to provide an image forming method in which the toner image is not deformed even when the vibration of the ultrasonic waves are applied and the toner images can be exactly overlapped to form a full color image.

SUMMARY

In an image forming method which uses supersonic oscillation when developing an electrostatic latent image on a latent image bearing body with toner, or when transferring a toner image on a transfer material, the first aspect is the image forming method characterized in that toner particles which form the toner image contain the releasing agent whose melting point is 40-70° C., and the median size D50 of the number basis of the toner is 3 to 5 μm, and CV value in the particle size distribution of the number basis of the toner defined by the following formula is 12 to 20%.

In an image forming method which uses supersonic oscillation when developing an electrostatic latent image on a latent image bearing body with toner, or when transferring a toner image on a transfer material, the second aspect is the image forming method characterized in that toner particles which form the toner image contain the releasing agent whose melting point is 40 to 70° C., and the median size D50 of the number basis of the toner is 3 to 5 μm, and the mean value of circularity is 0.975 to 1.0.

BRIEF DESCRIPTION OF THE DRAWINGS

FIGS. 6(*a*) and 6(*b*) are schematic diagrams of an example of dispersion suspension apparatus which can carry out monitoring used by a manufacturing process of toner.

DETAIL DESCRIPTION OF THE EXEMPLARY EMBODIMENTS

Figure 1:
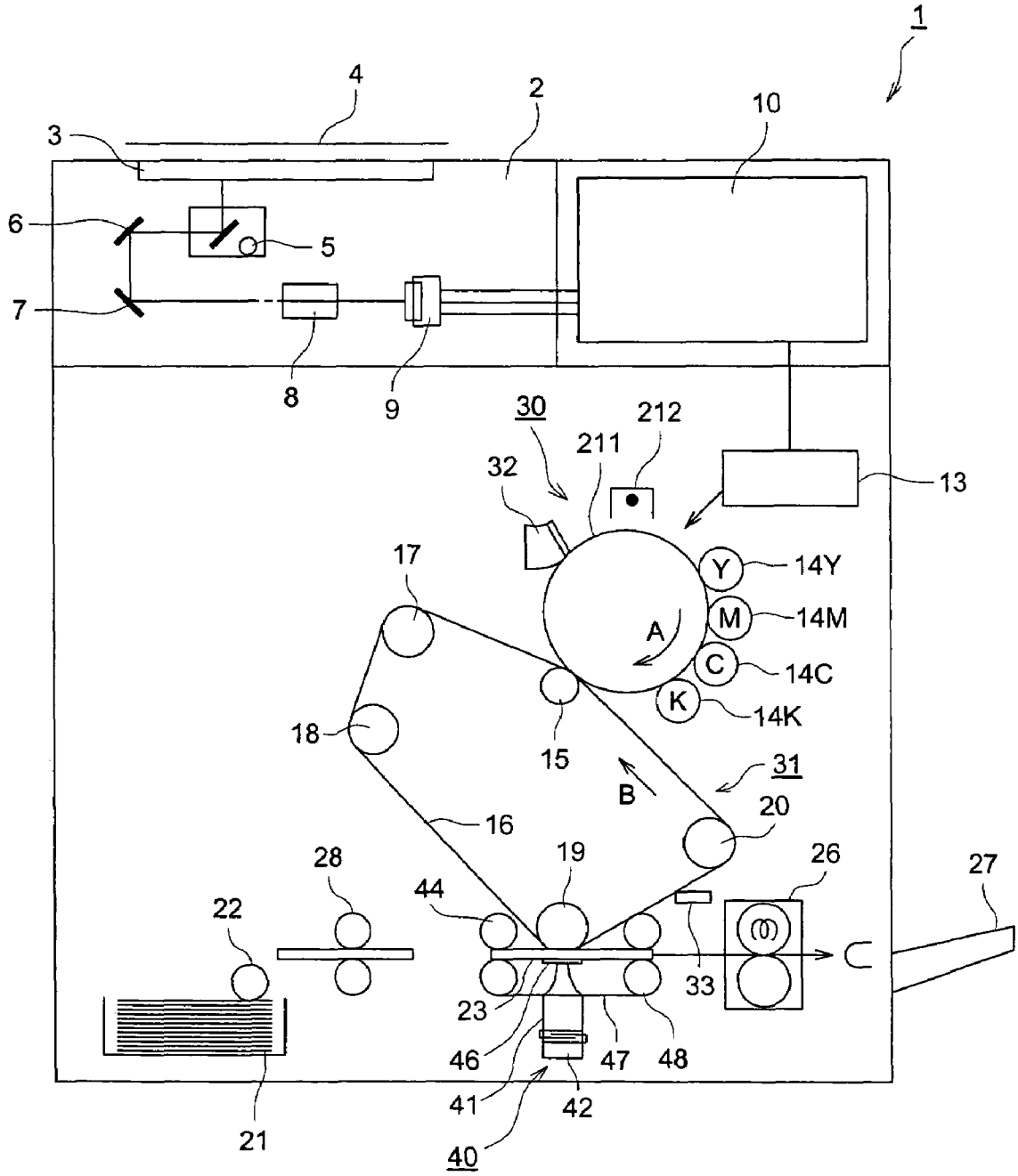
FIG. 1 is a schematic illustration showing an example of the image forming apparatus preferably employed in the invention.

The inventors estimated that a releasing agent phase is liable to be eliminated from toner particles as a result of concentration of ultrasonic vibrations to the interface of a releasing agent phase and a binder resin phase of the toner surface when ultrasonic vibrations were applied to oilless toner particles.

The inventors have tried to develop stable toner particles in which a releasing agent phase is never eliminated from the toner particles when ultrasonic vibrations are applied, and have found that a number particle size distribution of toner particles functions as a factor contributing to prevent elimination of a releasing agent phase.

Further, it has been found that a toner having a diameter as small as 3-5 μm is suitable for ultrasonic waves of higher frequencies. That is, a toner having a diameter of 3-5 μm is naturally suitable for an image formation of high image quality being excellent in fine line reproduction as well as has a merit of not causing users anxiety because transfer is performed by ultrasonic waves which is not detected by human ears.

In other words, the first aspect of this invention is:

(1) An image forming method in which ultrasonic vibrations are utilized when an electrostatic latent image on a latent image carrier is developed with toner or a toner image is transferred onto a transfer material, wherein toner particles forming said toner image contain a releasing agent having a melting point of 40-75° C., a median diameter by number D50 of said toner is 3-5 μm, and a CV value in a particle size distribution by number defined by the following equation is 12-20%.

$$CV \text{ value } (\%) = (\text{standard deviation of number particle size distribution/median diameter by number } D50) \times 100$$

According to the above constitution described above (1), when an image formation provided with a transfer process by means of ultrasonic vibrations is performed utilizing oilless toner having a number particle size distribution in a specific range, a transfer material, on which a toner image is formed, is prevented from coiling round on a fixing roller or generating offset as well as toner images of each color accumulate precisely to form an excellent full color image without image distortion.

Further, in the above constitution, stable image formation is possible without eliminating a releasing agent phase from toner particles even a transfer process by means of ultrasonic vibrations being performed, when toner utilized in image formation has a CV value of a number particle size distribution of a range of 12-20%.

As described above, the inventors have confirmed that image formation exhibiting excellent transfer capability is achieved when image formation provided with a transfer process by means of ultrasonic vibrations is performed utilizing a specific oilless toner. The reason is estimated as electrostatic force between the toner particles attached on a photoreceptor surface and the photoreceptor surface is probably made uniform at the time of image formation by setting a CV value in particle size distribution by number of toner in the above range and the whole toner particles can be efficiently separated from the photoreceptor surface to be stably transferred onto a transfer material by application of ultrasonic vibrations.

The above-described toner is preferably prepared by way of a process satisfying any or all of the following conditions.

(2) The aforesaid toner is formed by aggregating resin particles containing a releasing agent in a water-based medium.

(3) The aforesaid toner is prepared in such a manner that a polymerizable monomer, in which a releasing agent is dissolved, is polymerized to form the above-described resin particles and said resin particles are aggregated in a water-based medium.

(4) The aforesaid toner is prepared by aggregating resin particles and releasing agent particles in a water-based medium.

A toner prepared by way of a manufacturing process described in any of (1)-(4) is a so-called polymerized toner, and utilizing a toner described at least in any of (2)-(4) enables not to generate image distortion even when an image formed on a transfer material is subjected to ultrasonic waves. It is estimated that the toner particle diameter has a small variation as described before as well as utilization of polymerized toner makes ultrasonic wave energy, which is applied on a toner image, uniform due to uniform shapes of each toner particle, resulting in toner image formation without image distortions.

By performing image formation by use of a toner in which a median diameter by number D50 and a CV value of a particle diameter distribution by number is controlled to be in a specific range, toner particles are prevented from being destroyed because a releasing agent is never eliminated by an effect of vibrations and jamming or offset, being caused by coiling around of a transfer material around a fixing roller due to destruction of toner particles, is avoided, which enables image formation exhibiting stable fixing capability.

Further, as a result of no elimination of a releasing agent from toner particles and stabilization of toner particles against vibrations, full color image provided with excellent image quality can be stably formed by restraining generation of image distortions and precisely accumulating toner images of each color.

Further, the inventors have studied a structure of toner particles which enable effective transfer of the toner particles from a photoreceptor to a transfer material in a transfer process employing ultrasonic vibrations.

And, the inventors found that by utilizing toner particles having a small particle diameter provided with a near spherical shape as described in following (5), the toner particles are effectively transferred from a photoreceptor onto a transfer material at the time of a transfer process as well as a toner image formed on the transfer material never generates image distortions due to vibrations of ultrasonic waves.

(5) An image forming method in which ultrasonic vibrations are utilized when an electrostatic latent image on a latent image carrier is developed with toner or a toner image is transferred onto a transfer material, wherein toner particles forming said toner image contain a releasing agent having a melting point of 40-75° C., and said toner is provided with a mean circularity of 0.975-1.000 and median diameter by number D50 of 3.0-5.0 μm.

According to the constitution described in above (5), it has been found that a transfer property in a transfer process employing ultrasonic waves is remarkably improved by utilizing toner containing a releasing agent having a melting point of a specific range, and provided with a median diameter by number D50 of a specific range and a mean circularity of the above-described range.

At first, it was expected that the contact area of toner particles at a photoreceptor surface is too small for the toner particles to adhere onto the photoreceptor surface when a toner provided with a near spherical shape is utilized, however, in this invention, it has been confirmed that a predetermined amount of toner surely adheres on the photoreceptor surface to form a toner image having a predetermined density as well as stable transfer is performed.

Further, it was expected that a toner image on a transfer medium is liable to be disturbed due to vibrations of ultrasonic waves because toner has a near spherical shape, however a toner image having an excellent fine line reproducibility without causing image distortions due to ultrasonic waves.

The reason is not clear why no expected problems, which may be generated due to the shape, were caused even when a toner provided with a near spherical shape is utilized, however, it is estimated that probably the small toner particle diameter acted as a factor to surely perform toner adhesion onto the photoreceptor surface.

That is, it is estimated that possible to be worked an electrostatic attractive force enough to form a toner image even with a small contact area due to toner particles having a small particle diameter, and definite transfer is performed by releasing adhesion of toner onto a photoreceptor by a function of ultrasonic waves at the time of transfer.

Further, not clear is the reason why no image distortions generated even when a toner image is subjected to an action of ultrasonic waves on a transfer medium, however, it is estimated that, probably, since the toner shape is uniform to certain extent and the particle diameter is small, energy from ultrasonic waves irradiated uniformly on each toner particle to generate no local problems on a toner image resulting in no generation of image distortions.

Further, the inventors also found that more excellent image formation can be performed by preparing the utilized toner via a manufacturing process described in following (6).

(6) The image forming method described in above (5) characterized in that the aforesaid toner particles are obtained via a process in which resin and a colorant are dissolved or dispersed in a solvent, the resulting solution is further dispersing suspended in a water-based medium to form a suspension, and the solvent is removed from said suspension.

By utilizing toner which contains a releasing agent having a melting point of 40-75° C., and is controlled to have a mean circularity of 0.975-1.000 and a median diameter by number D50 of 3.0-5.0 μm, a releasing agent is never eliminated with an effect of vibrations and jamming or offset, being caused by coiling around of a transfer material around a fixing roller due to destruction of toner particles, is avoided even when image formation including a transfer process employing ultrasonic vibrations is performed, which enables image formation exhibiting stable fixing capability.

Further, as a result of no elimination of a releasing agent from toner particles and stabilization of toner particles against vibrations, image distortions are restrained and toner images of each color are accurately accumulated to enable stable formation of a full color image provided with excellent image quality.

In the following, detailed explanation will be made.

This invention relates to an image forming method which is provided with a transfer process in which a toner image on a photoreceptor is transferred onto a transfer medium by irradiating ultrasonic waves of a predetermined wavelength onto an image forming support and a transfer medium at the time of transferring a toner image formed on a latent image carrying element (also referred to as an image forming support), that is a photoreceptor, to a transfer medium, wherein utilized is toner (1) containing a releasing agent having a melting point of 40-75° C. and provided with a median diameter by number D50 of 3.0-5.0 μm; (2) having a CV value in a particle size distribution by number of 12-20% and a mean circularity of 0.975-1.000.

A CV value in a particle size distribution by number is dispersibility in a particle size distribution expressed based on number, and defined according to the following equation. It is meant that the smaller is this CV value, the sharper is a particle size distribution and the more uniform is the size of toner particles.

$$CV \text{ value } (\%) = (\text{standard deviation of number particle size distribution/median diameter by number } D50) \times 100$$

wherein a CV value of toner of this invention is preferably adjusted in a range of 12.0-20.0 and more preferably in a range of 12.0-15.0.

A CV value in a particle size distribution by number of toner is the value determined in such a manner that particle diameter data of the samples, which has been measured by Coulter Multisizer according to the conditions described below, is transferred to a computer through an I/O unit and followed by calculation according to a particle size distribution analyzing program in said computer.

[Measurement Conditions]

(1) Aperture: 100 μm, (2) Sample Preparation Method: A suitable amount of a surfactant is added in 50-100 ml of an electrolytic solution [ISOTON R-II (manufactured by Coulter Scientific Japan Corp.)] and stirred, and 10-20 ml of the sample to be measured is added to the resulting solution. The system is subjected to a dispersion treatment by an ultrasonic homogenizer for 1 minute.

The particle size distribution of the particles can be controlled by manufacturing conditions [such as a resin (polymer) composition, a coagulant utilized in a association polymerization method described later, and an organic solvent].

$$CV = \sigma 50 / D50$$

D50: a 50% diameter of a particle size distribution (a median diameter by number)

σ50: a standard deviation based on D50

(Explanation of Toner Particle Diameter)

Toner having a median diameter by number D50 of 3.0-5.0 μm and preferably of 3.5-4.0 μm is utilized. Herein, a median diameter by number D50 means a particle diameter (a 50% diameter) at 50% accumulation in a particle size distribution by number. The median diameter by number D50 can be controlled by such as a concentration or an addition timing of a coagulant (a salting out agent), or by temperature.

In this invention, it has been confirmed that fine line reproducibility and a dot image in addition to the aforesaid problems are remarkably improved by setting a median diameter by number D50 of toner, which is utilized in an image forming method provided with a transfer process employing ultrasonic vibrations, in a range of 3.0-5.0 μm and preferably in a range of 3.5-4.0 μm, and this can be also applied to image formation of a 1200 dpi level.

Further, the measurement of a median diameter by number D50 of toner is performed by use of Coulter Multisizer (also manufactured by Coulter Corp.) under similar conditions to those of a CV value measurement described above.

As for the shape of toner particles, a mean circularity defined by the following equation is 0.975-1.000 and preferably 0.985-1.000.

$$\text{Mean circularity} = (\text{circumferential length determined from equivalent circle diameter})/(\text{circumferential length of projected image of particle})$$

Circularity is measured by FPIA-1000 (manufactured by To a Medical Electronics Co., Ltd.). However another apparatus can be used if there is no significant difference in the measured data from FPIA-1000.

It has been confirmed that toner particles forming an image are provided with excellent transfer capability and stability against ultrasonic waves by setting a mean circularity of toner to 0.975-1.000. That is, it is estimated that toner as small as having a median diameter by number D50 of 3.0-5.0 μm exhibits stable transfer capability because toner particles are held by a function of an electrostatic attractive force on a photoreceptor surface even in the case of a near spherical shape of the toner.

Further, it has been confirmed that thermal conduction is made efficient to improve a fixing property when toner is provided with the above-described mean circularity. In addition to this, it has been confirmed that a degree of irregularity of toner particles is possible to be depressed and breakage of toner due to stress over a long term usage is possible to be depressed when toner is provided with the above-described mean circularity.

The distribution of toner circularity described above is preferably sharp. A means to specify variation of a mean circularity includes a CV value (Coefficient Value) defined by the following equation. A CV value is calculated from a standard deviation and a mean circularity, by calculating the standard deviation from circularity of toner particles utilized at the time of calculating the above-described circularity. Herein, a standard deviation is preferably not more than 0.10, and a CV value represented by the following equation is preferably less than 20% and more preferably less than 10%.

$$CV\text{ value}=[(\text{standard deviation of circularity})/(\text{mean circularity})]\times 100$$

The distribution of circularity of toner is preferably sharp, and since the shape of toner particles are uniform by setting a value of a standard deviation of circularity to not more than 10% resulting in enabling differences of transfer capability of individual toner particles adhered on the photoreceptor surface to be small, improvement of a transfer ratio is exhibited as well as an effect of ultrasonic waves is made uniform which is effective for prevention of image distortions.

Further, by setting a CV value to less than 20%, a sharp distribution of the shape can be achieved similarly, and improvement of transfer capability and depression of image distortion due to ultrasonic waves can be more effectively exhibited.

A method to control the shape and size of toner particles so as to make a mean circularity and a median diameter by number D50 of the range described above includes, for example, a method in which the size and shape are controlled by deciding a suitable timing to finish the process while monitoring the toner particles the shape and size of which are under control in such as a dispersing suspension process or monitoring the characteristics of the toner particles (colored particles) the shape of which are under control in such as an association process.

Monitoring means to control the process conditions based on the measurement results which are obtained by a measurement device being arranged in the line. That is, it is possible to stop the reaction when a desired shape is obtained by arranging a measurement means of such as a shape to measure the shape and particle diameter with successive sampling, for example, in such as a fusing process, in the case of polymerization toner formed by association or fusion of resin particles in a water-based medium.

A monitoring method is not specifically limited, and includes a method in which monitoring is performed by use of such as Flow-type Particle Image Analyzer FPIA-1000 (manufactured by Toa Medical Electronics Co., Ltd.), Coulter Multisizer and Coulter TA-II. These devices are preferable because they can monitor a shape by performing image analysis on real-time while passing a sample liquid through said device. That is, such as a shape is measured while always monitoring by use of a pump working from the reaction point and the reaction is stopped when a desired shape and size are obtained.

In toner, a releasing agent is appropriately added to respond the requirement in recent years for oilless fixing. By addition of a releasing agent, a peeling additive such as silicone oil, which is conventionally applied on the surface of a fixing member, can be eliminated, so that glossiness unevenness due to transfer of a peeling additive to a fixing substrate (a paper sheet) can be reduced. Therefore, a constitution of a fixing device itself can be simplified resulting in being effective to make a fixing device compact.

Herein, specific examples of a releasing agent utilized include lower molecular weight polyolefins such as polyethylene, polypropylene and polybutene; silicones which exhibit a softening point on heating; fatty acid amides such as oleic acid amide, erucic acid amide, ricinoleic acid amide and stearic acid amide; vegetable waxes such as carnauba wax, rice wax, candelilla wax, wood wax and hohoba oil; animal waxes such as bees wax; mineral-petroleum waxes such as montan wax, ozokerite, ceresine, paraffin wax, micro-crystalline wax and Fischer-Tropsch wax; ester waxes of a higher fatty acid and a higher alcohol such as stearyl stearate, behenyl behenate and myristyl myristate, ester waxes of a higher fatty acid and a mono-hydric or poly-hydric alcohol such as butyl stearate, glycerid monostearate, grycerid distearate and pentaerythritol tetrabehanate; ester waxes comprising a higher fatty acid and a polyhydric alcohol polymeric substance such as diethyleneglycol monostearate, dipropyleneglycol distearate, diglyceride distearate and triglyceride tetrastearate; sorbitan higer fatty acid ester waxes such as sorbitan monostearate; and cholesterol higher fatty acid ester waxes such as cholesteryl stearate. These releasing agents can be utilized alone or in combination of two or more types.

The addition amount of these releasing agent is suitably 0.5-50 weight %, preferably 1-30 weight % and more preferably 5-15 weight %, based on toner. By setting the addition amount of a releasing agent in such a range, bleeding out of the releasing agent onto the image surface at the time of fixing is sufficiently exhibited to provide excellent releasing capability, as well as a full color image securing sufficient transparency can be obtained when image formation is performed on an OHP sheet.

Further, it has been confirmed that by utilizing toner containing, among releasing agents described above, one specifically having a melting point in a range of 40-75° C. and preferably of 45-75° C., exhibits stable image forming capability is exhibited in an image forming apparatus provided with a transfer process employing ultrasonic vibrations. That is, it is estimated because, in a releasing agent having a melting point in a range of 40-75° C., a strong adhesive function is exhibited at the interface between a resin component constituting toner particles and said releasing agent component, resulting in no elimination of a releasing agent from toner particles which may be caused by an effect of ultrasonic vibrations in a transfer process, and providing toner particles with stability against vibrations.

Herein, a melting point of a releasing agent contained in toner particles utilized in this invention can be measured, for example, by a differential thermal analyzer (DSC). Specifically, a temperature, at which the maximum peak of an endothermic peak is shown, is defined as a melting point when a temperature is raised at 10° C./min from 0 to 200° C.

A specific measurement device of a melting point includes such as DSC-7 manufactured by Perkin Elmer Corp. Herein, a melting point of a releasing agent may be measured while employing a releasing agent itself as a sample by use of said apparatus. However, toner can also be employed as a sample in the case that the maximum peak of an endothermic peak is evident to arise from a releasing agent even when the measurement is performed by setting toner containing a releasing agent in said apparatus.

As a releasing agent which exhibits such a functional effect, confirmed to be specifically preferable are fatty acid monohydric alcohol esters and distearyl cebacate such as behenic behenate, stearyl stearate and myristyl myristate.

A method to add a releasing agent in toner includes, for example, methods which are utilized in the manufacturing method of toner described in Japanese Patent Publication Open to Public Inspection No. 2001-109189. Specifically, listed are a method in which a releasing agent particles are prepared and coagulated with resin particles in the presence of colorant particles resulting in addition of the releasing agent into toner particles, and a method in which a releasing agent is dissolved in a monomer for resin particle preparation, and resin particles are formed by polymerization resulting in addition of the releasing agent in toner particles followed by salting out/fusing process together with colored particles.

A manufacturing method of toner applicable in this invention will be explained later.

Next, an image forming apparatus utilizable will be explained.

A full color image is formed by means of transfer while applying ultrasonic vibrations to a toner image, at the time of transferring a toner image formed on an image carrier member onto a transfer material such as a paper sheet, or at the time of transferring a toner image formed on an image carrier member onto an intermediate transfer member while being accumulated, and further at the time of transferring an accumulated toner image on an intermediate transfer member to a transfer material.

Figure 2:
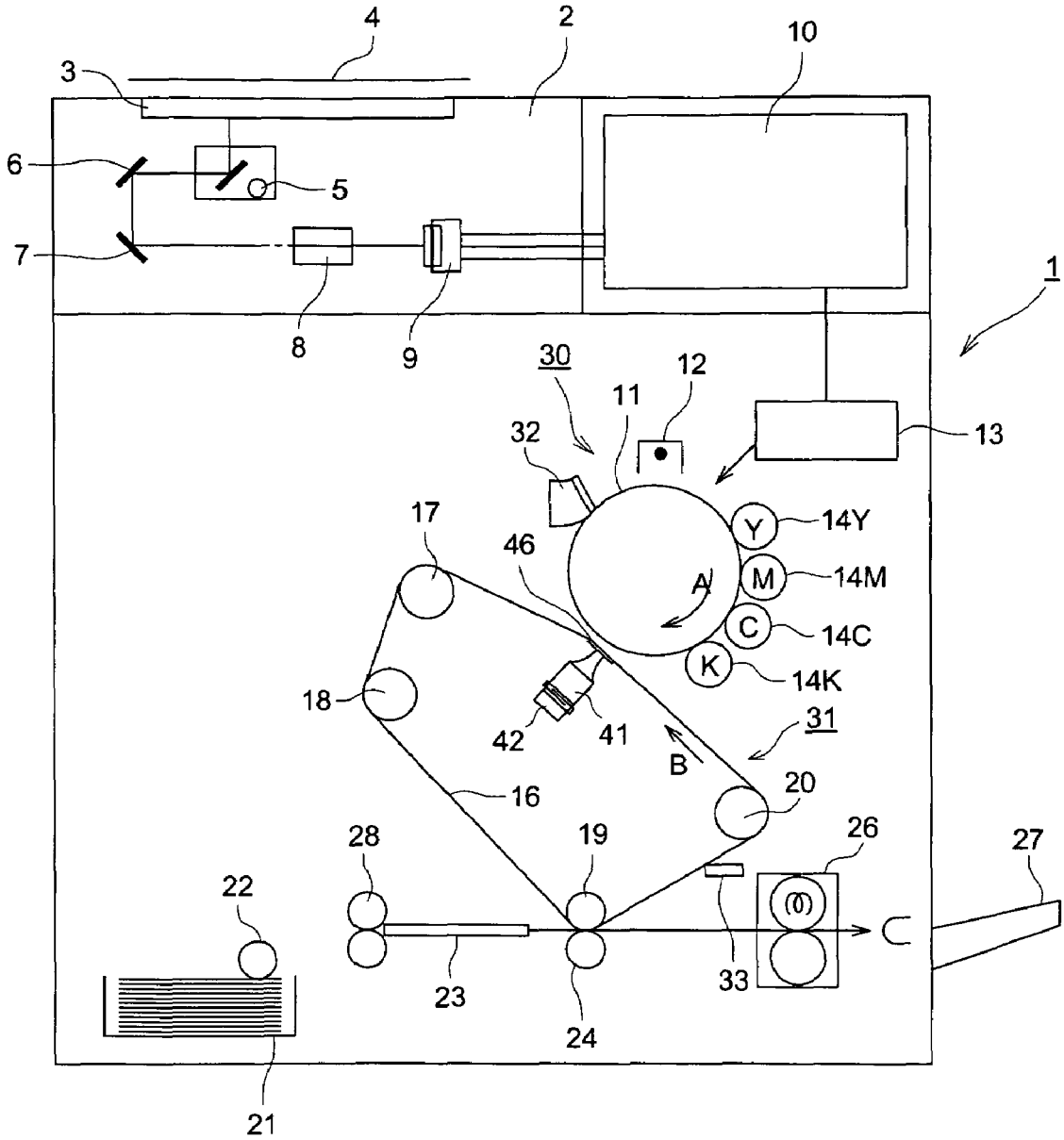
FIG. 2 is a schematic illustration showing an example of the image forming apparatus in which the toner image on the photoreceptor drum is transferred to an intermediate transfer member.
Figure 3:
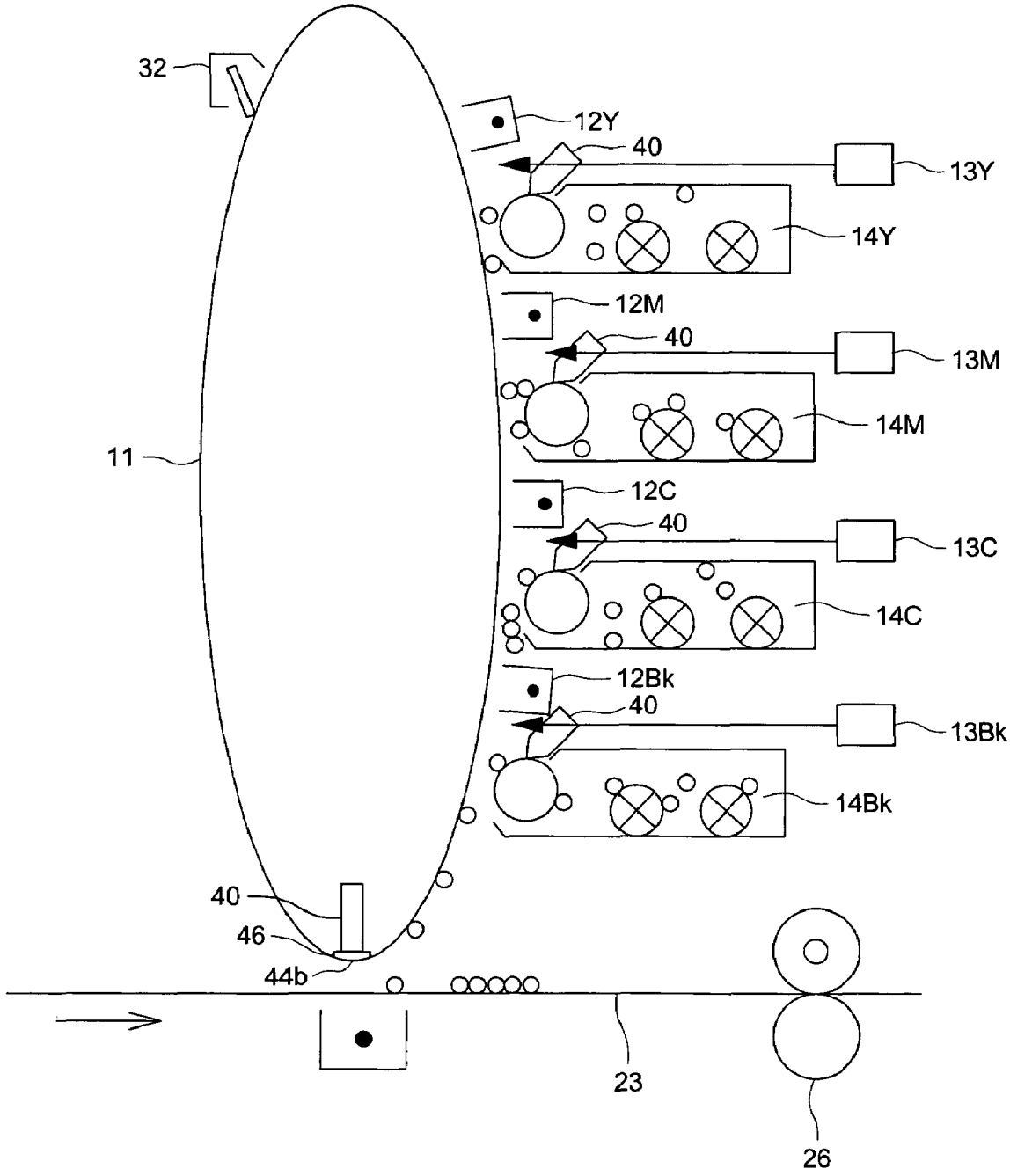
FIG. 3 is a schematic illustration showing another example of image forming apparatus to be employable in the invention.

FIGS. 1, 2 and 3 each is a schematic illustration showing an example of image forming apparatus to be preferably employed in the invention.

Although these are explained below, given reference numbers are common as long as there is no interpretation in particular.

Moreover, depending on drawing, the structure shown by a reference number may not be illustrated concretely. The image formation apparatus of FIG. 1 is a schematic illustration view showing an apparatus.

The image forming apparatus has a drum-shaped photoreceptor 11 rotatable in the direction of arrow A, and an original reading means 2 for reading the image of original 4 is arranged at the upper portion of the body of the color forming apparatus 1.

The image reading means has a platen glass 3, a light source 5, two scanning mirrors 6 and 7, a focusing lens 8 and a color CCD sensor 9.

In the body of the color image forming apparatus 1, an image forming unit 30, an intermediate transferring member unit 31 are arranged.

In the image forming unit 30, a charging device 12 for almost uniformly charging the photoreceptor drum 11, a laser beam scanning device for writing a static latent image by irradiating a laser beam to the photoreceptor drum 11, and developing devices 14Y, 14M, 14C and 14K each containing a Yellow (Y), magenta (M), cyan (C) and black (Bk) toners, respectively, are arranged around the photoreceptor drum 11.

In the intermediate transfer unit, an intermediate transfer belt 16 is provided which is suspended by a driving roller 17, idling rollers 18 and 20, and a secondary transferring backup roller 19, and the intermediate transfer belt 16 is driven by a driving roller 17 so as to be circulated in the direction of arrow B.

At the lower portion of the body of the image forming apparatus 1, a paper supplying cassette containing paper 32, a conveying roller for picking up and conveying the paper 23 one by one, and a register roller 28 for conveying the paper 32 to the position facing to the intermediate transfer belt 16, are provided.

In FIG. 1, an ultrasonic wave generation element 42 and a horn 41 are arranged at the portion where the intermediate transfer belt 16 is faced to the image receiving material, and in FIG. 2 they are arranged at the back side of the intermediate transfer belt.

Moreover, a fixing device 26 for fixing the toner image transferred onto the paper and a tray 27 onto which the paper after fixing is output are provided.

Figure 4:
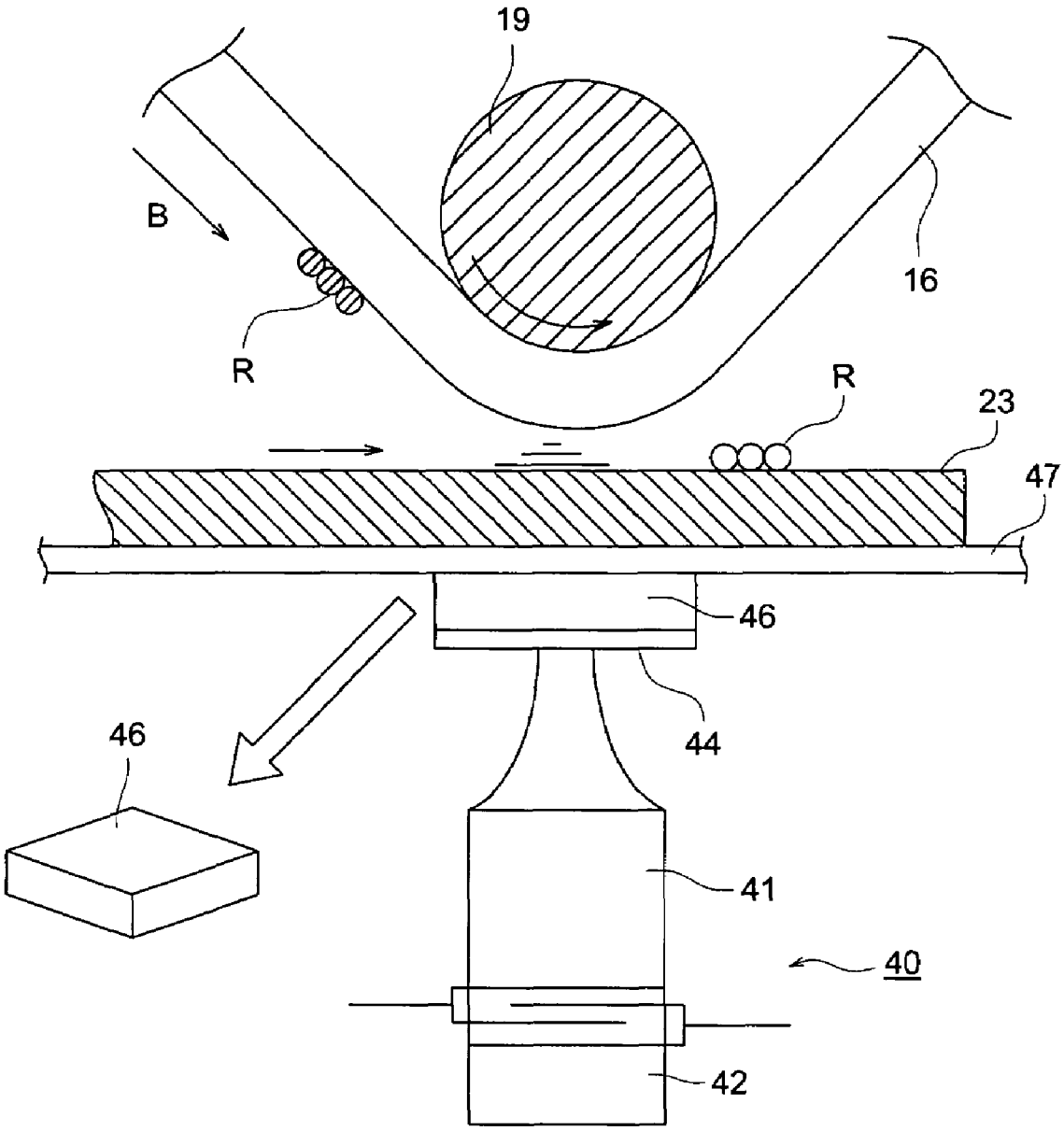
FIG. 4 is a schematic illustration showing the transferring position of the intermediate transfer belt 16 and the image receiving material.
Figure 5:
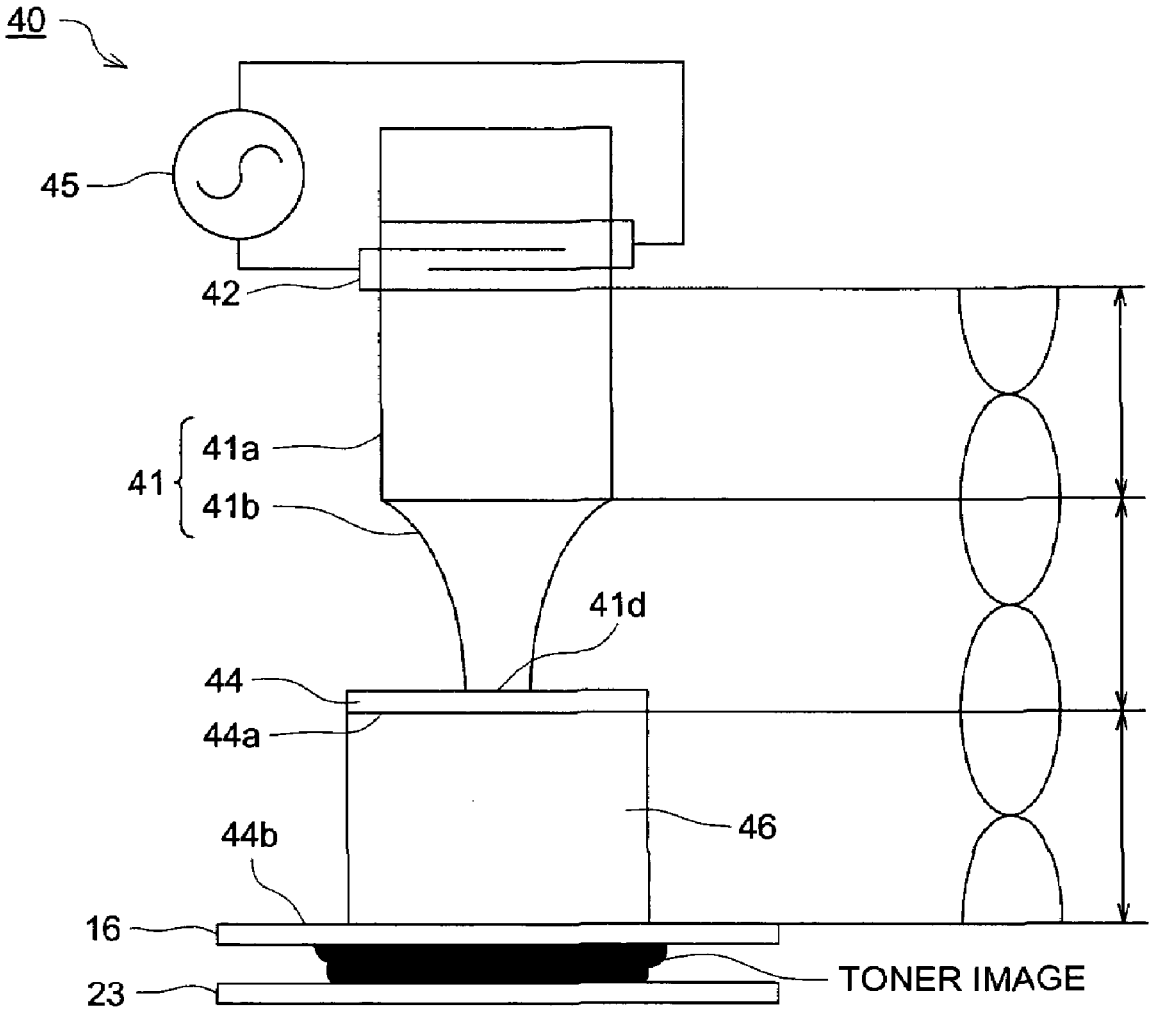
FIG. 5 is a schematic illustration view of an example of an ultrasonic radiation device.

FIG. 4 is a schematic illustration of a typical ultrasonic wave apparatus 40 to be employed in the invention. FIG. 5 is an enlarged view of them.

The ultrasonic wave apparatus 40 is constituted by an ultrasonic wave generation element 42, a horn 41 for introducing the generated ultrasonic waves to an ultrasonic wave irradiating face 44*a*, and a high frequency power source 45. The ultrasonic apparatus is not limited to it.

As the ultrasonic wave generation element 42 shown in FIG. 5, for example, a ceramic type piezoelectric element is employed for generating strong ultrasonic waves.

The ultrasonic wave generation element 42 is strongly fixed by an organic adhering agent to a straight pipe portion 41*a* of the horn 41 composed of the strait pipe portion 41 and a horn portion 41*b*, each of which has a length L. The length L is integer times of ½ of the sonic wavelength of l1 defined by the resonance frequency of the ultrasonic wave generation element and the sonic speed in the material.

The horn portion 41*b* is formed as a bugle-like shape in which the cross section area thereof is made so as to be gradually smaller toward from the straight pipe portion 41*a* contacted with the ultrasonic generation element 42 to the end of the horn portion 41*b*. The material constituting the horn 41 is typically SUS, and aluminum bronze, phosphor bronze, a titanium alloy and duralumin are usable other than USU.

The vibration amplitude of the ultrasonic wave generation element 42 can be amplified corresponding to the ratio of the area of the irradiating face 41*c* of the straight pipe portion 41*a* to the area of the end face 41*d* so that further strong ultrasonic waves can be irradiated. Moreover, the fatigue or the degradation of the vibrating property caused by the vibration stress can be prevented by decreasing the vibration amplitude of the ultrasonic wave generation element 42.

In this embodiment, the ratio of the area of the irradiation end 41*c* of the horn 41 to the area of the end face are 5:1; it has been confirmed that the vibration efficiency of the horn 41 is most effectively realized when the area ratio is near such the ratio.

Moreover, in the ultrasonic apparatus 40, an ultrasonic irradiating plate 44 is attached.

In FIG. 4, the ultrasonic irradiation plate has a disc shape having a diameter of 25 cm.

An ultrasonic wave irradiating face 44*a* is formed at the face of the ultrasonic irradiation plate facing to the subject.

As above-mentioned, it is made possible by the ultrasonic wave apparatus 40 that the ultrasonic waves are generated by the ultrasonic wave generation element 42 and the vibration amplitude of the ultrasonic waves is amplified by the use of the horn 41 and irradiated from the ultrasonic wave irradiation face 44*a* having a large area so that strong energy vibration is given to a wide area of the subject.

In the embodiment, thus constituted ultrasonic wave apparatus 40 are arranged as a strait line or a staggered line in the cross direction of the intermediate transfer belt 16 to form the ultrasonic wave vibrations applying means.

It is confirmed that a frequency of from 40 kHz to 2 MHz is suitable in the invention. The frequency within such the range is preferred since the thickness of the ultrasonic wave generation element has to be thin and the output of the ultrasonic waves is difficultly made large when the frequency is made high. Moreover, in the present invention, it is confirmed that in the image formation which transfers on the frequency of the above-mentioned range, by using small size toner whose median size D50 of a number basis is 3.0-5.0 μm, desirable image formation can be performed especially.

In the invention, it is preferable to provide a sheet-shaped gel member 46 as an ultrasonic wave conducting member as shown in FIGS. 4 and 5 between the intermediate transfer belt 16 or the conveying belt 47 and the ultrasonic irradiation face for obtaining high transfer efficiency at the transferring position. Other than the sheet shaped gel member, the gel member 46 may be formed by coating a gel material taken out from a tube on the ultrasonic wave irradiation plate 44.

The ultrasonic waves can be certainly conducted to the intermediate transfer belt 16, so as to raise the transfer efficiency at the transferring position by providing the ultrasonic wave conductive member at the transferring position. Moreover, the ultrasonic wave conductive member prevents rubbing the end portion of the ultrasonic wave apparatus 40 with the intermediate transfer belt 16 or the conveying belt 47 so that the members constituting the apparatus can be protected.

As the gel member 46, for example, 100% silicone is employed and functioned as the ultrasonic wave conducting member on the occasion of the transfer.

The gel member 46 most preferably employed in the invention is a sheet-shaped silicone type gel. The sheet-shaped silicone gel is preferable since the sheet-shaped gel can conduct the ultrasonic waves to the facing face 44 while the gel itself is almost not received the influence of pressure.

The silicone type gel is superior in the resistivity to heat and chemicals, and the properties thereof are almost not varied accompanied with the passing of time. Therefore, the silicone type gel can stably hold the ultrasonic wave conducting ability for long period and do not contaminate the environment, and it is confirmed that the silicone gel is superior in hygienic and environmental suitability.

Concrete examples of the sheet-shaped silicone type gel include a silicone gel sheet composed of a silicone gel layer laminated on a silicone rubber layer, cf. Japanese Patent O.P.I. Publication No. 2-196453, a silicone gel sheet composed of a silicone gel layer laminated on a silicon rubber sheet which is composed of a mesh-shaped reinforcing material such as glass cloth covered with hardened silicone rubber, cf. Japanese Patent O.P.I. Publication No. 6-155517, and a silicone gel sheet having a metal foil on one side thereof, cf. 6-201226. It is confirmed that any types of silicone gel sheet can be employed in the invention.

In the image forming apparatus shown in FIGS. 1 to 3, the ultrasonic irradiation face 44*a* of the ultrasonic apparatus 40 is faced in parallel to the intermediate transfer belt 16 or the photoreceptor belt 11 and the image receiving material 23 so the toner image is between them at the transferring position. When the portion of the intermediate transfer belt 16 facing to the ultrasonic irradiation face 44*a* is defined as face 44*b*, the distance L2 between the ultrasonic wave irradiation face 44*a* and the face 44*b* facing to the face 44*a* is set so that the L2 is corresponded to an integer times of ½ of the wavelength l2 of the ultrasonic waves irradiated from the ultrasonic wave irradiation face 44*a*. The distance L2 between the ultrasonic wave irradiation face 44*a* and the face 44*b* is preferred since the highest sensitivity can be obtained when the L2 is ½ of the wavelength l2.

It is supposed that such the phenomenon is caused by formation of a standing wave between the ultrasonic irradiation face 44*a* of the ultrasonic wave apparatus 40 and the facing face 44*b* by agreement of the phase of the ultrasonic waves irradiated from the ultrasonic irradiation face 44*a* of the ultrasonic wave apparatus 40 and that of the ultrasonic waves reflected by the facing face 44*b*.

When the standing wave is formed, force larger than that the simple irradiation of ultrasonic waves affects to the face 44*a* positioned at the antinode portion of the vibration of the standing wave. For example, when an ultrasonic wave generation element 42 having a resonance frequency of 40 kHz, the wavelength l2 of the irradiated ultrasonic waves is approximately 17 mm even though which is influenced a little by the atmosphere temperature because the value of the l2 is the quotient of the sonic speed in air by the resonance frequency.

Image of light reflected by the original placed on the platen glass 3 and lighted by the light source 5 is read by CCD sensor 9 through the two scanning mirrors 6 and 7 and the focusing lens 8 as image signals of B (blue), G (green) and R (red). The read B, G and R signals are input into an image signal processing means 10 and converted to YMCK (yellow, magenta, cyan and black) signals and temporarily stored in a memory provided in the image signal processing means 10 according to necessity.

The photoreceptor drum 11 is uniformly charged at the designated potential by a charging device 12 and a static latent image is formed by a laser beam scanning means 13.

The laser beam scanning means 10 scans the image carrying drum 11 by the laser beam according to the image data of each colors of yellow, magenta, cyan and black successively output from the image signal processing means 10, to perform imagewise exposure. Thus the static latent images are formed on the image carrying drum 11.

The static latent images formed on the photoreceptor drum 11 are each developed by the developing device 14Y, 14M, 14C and 14K to form yellow, magenta, cyan and black colored images, respectively. The toners of each color are negatively charged and adhered on the area exposed to the laser beam of the image carrying drum. One color of image is formed by one rotation of the image carrying drum 11, and four colored images are formed by four round of the drum.

The one color image formed by one rotation of the drum is transferred onto the intermediated transfer belt 16 on each time, and the four colored images are piled on the intermediate transfer belt 16 by repeating such the process for four times.

After transference of the four color images onto the intermediate transfer belt 16, the intermediate transfer belt is further circulated and the four color toner images are arrived at the position where the toner images are transferred to the image receiving material. The paper 23 contained in the paper supplying cassette 21 is conveyed by the conveying roller 22 synchronizing with the arrival of the piled toner images to the transferring position and further conveyed by the register roller 22 to the position of transfer from the intermediate transfer belt 16 to the image receiving material.

At the position of transfer from the intermediate transfer belt 16 to the image receiving material, the toner images on the intermediate transfer belt 16 are transferred onto the image receiving material by the ultrasonic wave generation element 42 and the horn 41.

FIG. 5 is a schematic illustration showing the transferring position of the intermediate transfer belt 16 and the image receiving material. At the transferring position where the intermediate transfer belt 16 and the image receiving material or paper 23 are faced to each other, the ultrasonic wave generation element 42 and the horn 41 are provided on back side of the paper 24. As is shown in FIG. 5, the end portion of the horn 41 is vibrated in the same phase (piston vibration) in the direction of the arrow and the standing wave is formed between the intermediate transfer belt 16 and the paper 24 around the horn.

To contribute with high efficiency the ultrasonic waves generated by the driving of the ultrasonic wave generation element 42 to the transfer, it is preferable that the paper 23 is strained by sufficient force so as to occur the ultrasonic vibration at the surface of the paper.

At the upper stream side and the lower stream side of the transferring position, pare of rollers 48 are arranged and a conveying belt 47 is provided between them to apply the strain force to the paper 23.

A power source, not shown in the drawing, may be attached to the rollers 48 and the conveying belt 47 for applying voltage in the direction so that the toner particles are not adhered.

As above-mentioned, the toner images piled on the intermediate transfer belt 16 is transferred onto the paper 23 at the transferring position by the ultrasonic waves.

A means utilizing static electricity force or heat for increasing the holding ability of the tone image may be provided to prevent the deformation if the image caused by the rebounding of the toner particle R or the use of paper having small mirror force generated by itself.

In concrete, a means in which a power source is connected to the horn 41 to apply voltage for holding the toner particle R, and a means in which a transferring roller capable of being applied voltage is touched to the back side of the paper 23 are employable. By such the means, charge is given to the paper 23 as to hold the toner particle R on the paper 23. A tension roller may be provided on the opposite side, through the horn 41, of the transfer holding roller may be arranged to prevent the slacking vibration of the paper 23.

The paper on which the toner image is transferred, is fixed by heating and pressure by the fixing device 26 and output on the tray 27, thus a series of color image forming cycle is completed.

On the other hand, the photoreceptor drum 11 after finishing of the image transfer to the intermediate transfer belt 16 is introduced to the next image forming cycle after removing of the toner remained on the surface by cleaning device 32. The intermediate transfer belt 16 after finishing of the image transfer to the paper 23 is introduced to next image forming cycle after removing of the toner remained on the surface of the intermediate transfer belt 16 by cleaning device 33.

As above-described, it is possible to fly the toner particle for transferring by utilizing the sonic irradiation force of the ultrasonic standing wave on the occasion of transfer the toner image on the intermediate transfer belt to the image receiving material (paper 23), and the destroying of the toner particle caused by the releasing the particle of the parting agent is avoided by the use of the toner in which the parting agent is dispersed in the specified state so that the occurrence of deformation of image at the time of transfer can be prevented.

The invention can be also applied to the process in which the ultrasonic vibration is applied for transfer the toner image formed on the photoreceptor to the intermediate transfer belt 16 other than the process for transferring the toner image on the intermediate transfer belt 16 to the image receiving material. FIG. 2 is a schematic illustration showing an example of the image forming apparatus in which the toner image on the photoreceptor drum is transferred onto the intermediate transfer belt by the ultrasonic waves transfer method. It is also preferred in FIG. 2 that the gel member 46 is employed as the ultrasonic wave conductive means between the intermediate transfer belt and the ultrasonic apparatus 40 even though the gel member is not displayed in the drawing.

FIG. 3 is a schematic illustration of another full color image forming apparatus employable in the invention. In the image forming apparatus of FIG. 3, the full color toner image formed on the photoreceptor 11 is transferred onto the image receiving material.

In the image formation apparatus of FIG. 3, the toner image of each color of yellow (Y), magenta (M), cyan (C), and black (BK) is formed in the circumference of a photoreceptor 11. In the image forming apparatus of FIG. 3, a unit image of yellow is firstly formed on the belt-shaped photoreceptor. The procedure is the same as that in the formation apparatus for the mono-color image; firstly the surface of the photoreceptor is uniformly charged by the charging device, the photoreceptor surface is imagewise exposed by the image exposure device and developed by the yellow color toner to form the yellow image.

A magenta, cyan and black images are formed on the same area of the photoreceptor by synchronized timing with the rotation of the photoreceptor 11.

When the photoreceptor 11 is arrived, by the continuation of the moving thereof, at the position of the ultrasonic apparatus corresponding to the facing face 44*b*, the full color toner image is transferred onto the image receiving material 23 conveyed by adjusted timing. The image receiving material 23 carrying the full color toner image is conveyed into the fixing device 26 and the color image is fixed on the image receiving material 23.

It is also preferable in FIG. 3 that the gel member 46 is provided as the ultrasonic wave conducting member between the facing face 44*b* and the ultrasonic apparatus 40.

The photoreceptor 11 is further continuously rotated after transfer of the toner image, and the remained toner and paper powder on the surface of the photoreceptor are removed by the cleaning device 33 having a blade and then the photoreceptor is reused for next image formation.

Next, examples of a production method of the toner which can be used for a present invention is explained.

Toner is produced by production methods, such as an emulsification association method, a suspension polymerization method, a dispersion polymerizing method, a melting suspension method, and a continuous system emulsification dispersion method.

Hereafter, a production method of toner by an emulsification association method which is excellent in the points that a particle size distribution is sharp and toner having CV value of 20 or less and excellent monodispersibility can be obtained, is explained.

The production method of toner by an emulsion polymerization is a method of forming toner particles in water base media, and is disclosed by the official gazette of TOKKAI No. 2002-351142 etc., for example.

Moreover, a method of manufacturing toner by carrying out salting-out/fusing for resin particles in water base media, disclosed by the official gazette of TOKKAIHEI No.

5-265252, the official gazette of TOKKAIHEI No. 6-329947 and the official gazette of TOKKAIHEI No. 9-15904, may be listed.

Concretely, after dispersing resin particles using an emulsifying agent in the water, the coagulator is added more than critical aggregation concentration so as to make the resin particles salting-out, at the same time, a particle size is grown up gradually while forming fused particles, by carrying out heating fusion above the glass transition temperature of the formed polymer itself, water is added so much to stop the particle size growth at the time that the particle size becomes a target particle size, furthermore, the particle surface is made smooth while heating and stirring, thereby a form is controlled and toner is prepared.

A production method of the toner by dispersion polymerization is a method of dissolving a monomer and a polymerization initiator simultaneously in a good solvent into which the monomer dissolves, depositing high molecular components which becomes hardly dissolving into the solvent along with advance of polymerization, and forming toner particles. As for the above-mentioned solvent, it is common that methanol is used, and it is common that solid liquid separation was performed in alcoholic media or in the water base media mixed alcohol with water.

Here, the water base media mean a media which consist of water 50-100 weight %, and a water-soluble organic solvent 0-50 weight %. As a water-soluble organic solvent, for example, methanol, ethanol, isopropanol, butanol, acetone, methyl ethyl ketone, tetrahydrofuran, etc. can be listed, an alcoholic base organic solvent which does not dissolve the resin obtained is desirable.

[Filtration•Washing Process]

The filtration•washing process is a filtration process to separate the toner particles from the toner particle dispersion obtained in the above process and a washing process to remove adhered substances such as the surfactant and the salting out agent from the separated toner particles as a cake like mass.

As the filtration method, usual methods such as a centrifugal method, a vacuum filtration method using a Nutsche funnel, and a filter press are applicable without any limitation.

[Drying Process]

This process is a process to dry the toner particles.

As the drying machine to be employed in this process, a spray drier, a vacuum freeze drying machine and a vacuum drier are employable, and a standing rack drying machine, a moving rack drying machine, a fluid bed drying machine, a rotary drying machine and a stirring drying machine are preferably employed.

The moisture content of the dried toner particles is preferably not more than 5% by weight and more preferably not more than 2% by weight.

The components to be employed in the toner production process are described in detail bellow.

(Polymerizable Monomer)

As the polymerizable monomer for forming the resin (binder) used for the present invention, a hydrophobic monomer is the essential constituting component and a cross linkable monomer is employed according to necessity. It is preferable to contain at least one kind of monomer having an acidic polar group or monomer having a basic polar group in the structure thereof as shown below.

(1) As the hydrophobic monomer constituting the monomer component, usually known monomers can be employed without any limitation. The monomer may be employed solely or in combination of two or more kinds thereof for satisfying required properties.

In concrete, aromatic mono-vinyl type monomers, (metha) acrylate type monomers, vinyl ester type monomers, vinyl ether type monomers, mono-olefin type monomers, di-olefin type monomers and halogenated olefin type monomers are employable.

Examples of the aromatic vinyl type monomer are styrene type monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

As the (meth)acrylate type monomers, acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl b-hydroxyacrylate, propyl g-aminoacrylate, stearyl methacrylate, dimethylaminoethyl methacrylate and diethylaminoethyl methacrylate are cited.

As the vinyl ester type monomers, vinyl acetate, vinyl propionate and vinyl benzoate, and as the vinylether type monomers, vinyl ethyl ether, vinyl isobutyl ether and vinyl phenyl ether are cited.

As the mono-olefin type monomers, ethylene, propylene, iso-butylene, 1-butene, 1-pnetene and 4-methyl-1-pentene, and as the di-olefin type monomers, butadiene, isoprene and chloroprene are cited.

(2) A crosslinkable monomer may be added to improve the properties of the resin particle.

As examples of the crosslinkable monomers, ones having two or more unsaturated bonds such as divinylbenzene, divinylnaphthalene, divinyl ether, diethylene glycol methacrylate, ethylene glycol dimethacrylate and diallyl phthalate are cited.

(3) As the monomers having an acidic polar group, (a) a,β-ethylenic unsaturated compounds each having a carboxyl group (—COOH), and (b) a,β-ethylenic unsaturated compounds each having a sulfonic group (—SO3) can be cited.

Examples of a,β-ethylenic unsaturated compounds each having a carboxyl group of (a) are acrylic acid, methacrylic a acid, a fumalic acid, maleic acid, itaconic acid, cinnamic acid, mono-butyl maleate, mono-octyl maleate and their salts of a metal such as Na and Zn.

Examples of a,β-ethylenic unsaturated compounds each having a sulfonic group of (b) are sulfonated styrene and Na salt thereof, allylsulfosuccinic acid, octyl allylsulfosuccinate and their Na salts.

(Polymerization Initiator)

Radical polymerization initiators can be optionally employed as long as it is water soluble.

For example, persulfates such as potassium persulfate and ammonium persulfate, azo compounds such as 4,4'-azo-bis-4-valeriate and its salt and 2,2'-azo-bis(2-aminopropane) salt, and peroxide compounds can be cited. The above-mentioned radical polymerization initiator can be employed as redox initiators in combination with a reducing agent according to necessity. The use of the redox type initiator shows some merits such as that the polymerization activity is increased so that the polymerization temperature can be lowered and the polymerization time can be shortened.

The polymerization temperature is not specifically limited as long as it is higher than the lowest radical generation temperature, for example, within the range of from 50° C. to 90° C. The polymerization can be also performed at a room temperature or more by the use of an initiator capable of initiating the polymerization at an ordinary temperature such as a combination of hydrogen peroxide and a reducing agent such as ascorbic acid.

(Chain-transfer Agent)

Known chain-transfer agents can be employed for controlling the molecular weight. Though the chain-transfer agent is not specifically limited, for example, octylmercaptane, dodecylmercaptane, tert-dodecylmercaptane, n-octyl-3-mercaptopropionate, ethyl thioglycolate, propyl thioglycolate, propyl thioglycolate, butyl thioglycolate, 2-ethylhexyl thioglycolate, octyl thioglycolate, decyl thioglycolate, dodecyl thioglycolate and compounds of ethylene glycol having a mercapto group are employable. Among them, n-octyl-3-mercaptopropionates and n-octylmercaptane are particularly preferable from the viewpoint of inhibiting the odor on the occasion of thermally fixing of the toner.

(Surfactant)

For performing the mini-emulsion polymerization, it is preferable that the monomer is dispersed in a state of oil droplet in the aqueous medium employing a surfactant. Though the surfactant to be used on such the occasion is not specifically limiter, the following surfactants can be exemplified as the suitable compounds.

As the ionic surfactant, for example, sulfonates such as sodium dodecylbenzenesulfonate, sodium aryl alkyl polyethersulfonate, sodium 3,3-disulfondiphenylurea-4,4-diazo-bis-amino-8-naphthol-6-sulfonat, orthocarboxybenzene-azo-dimethylaniline and sodium 2,2,5,5-tetramethyl-triphenylmethane-4,4-diazo-bis-β-naphthol-6-sulfonate, sulfate salts such as sodium dodecylsulfate, sodium tetradecylsulfate, sodium pentadecylsuofate and sodium octylsulfate; aliphatic acid salts such as sodium oleate, sodium laurate, sodium caprylate, sodium caprate, sodium caproate, potassium stearate and calcium oleate are cited.

The combination use of the following surfactant represented by Formula (1) and that represented by Formula (2) is preferred.

$$R_1(OR_2)_nOSO_3M \qquad \text{Formula (1)}$$

$$R_1(OR_2)_nSO_3M \qquad \text{Formula (2)}$$

In Formulas (1) and (2), $R_1$ is an alkyl group or an arylalkyl group having from 6 to 22 carbon atoms, preferably an alkyl or an arylalkyl group having from 8 to 20 carbon atoms, and more preferably an alkyl or an arylalkyl group having from 9 to 16 carbon atoms.

In Formulas (1) and (2), $R_2$ is an alkylene group having from 2 to 6 carbon atoms, and preferably an alkylene group having from 2 to 3 carbon atoms. Examples of the alkylene group having from 2 to 6 carbon atoms represented by $R_2$ are an ethylene group, a trimethylene group, a tetramethylene group, a propylene group and an ethylethylene group.

In Formulas (1) and (2), n is an integer of from 1 to 11, preferably from 2 to 10, more preferably from 2 to 5, and particularly preferably from 2 to 3.

In Formulas (1) and (2), the mono-valent metal element represented by M is sodium and lithium. Among them, sodium is preferably employed. Concrete examples of the surfactant represented by Formula (1) or (2) are listed below; the invention is not limited to them.

Compound (101): $C_{10}H_{21}(OCH_2CH_2)_2OSO_3Na$,
Compound (102): $C_{10}H_{21}(OCH_2CH_2)_3OSO_3Na$,
Compound (103): $C_{10}H_{21}(OCH_2CH_2)_2SO_3Na$
Compound (104): $C_{10}H_{21}(OCH_2CH_2)_3SO_3Na$,
Compound (105): $C_8H_{17}(OCH_2CH(CH_3))_2OSO_3Na$, and
Compound (106): $C_{13}H_{37}(OCH_2CH_2)_2OSO_3Na$ (Molecular Weight Distribution of Toner)

As for the toner of a present invention, it is desirable that the peak or shoulder portion of the molecular weight distribution exists in 100,000-1,000,000, and 1,000-50,000, furthermore, it is desirable that the peak or shoulder portion of molecular weight distribution exists in 100,000-1,000,000, 25,000-150,000, and 1,000-50,000.

As the resin of the resin particle, the use of one containing at least a high molecular weight component having the peak or shoulder of the molecular weight distribution within the range of from 100,000 to 1,000,000 and a low molecular weight component having the peak or shoulder within the range of from 1,000 to 50,000 is preferable and the use of intermediate molecular weight resin having the peak or shoulder within the range of from 15,000 to 100,000 is more preferable.

For measuring the molecular weight of the toner or the resin, the molecular weight measuring method by a gel permeation chromatography (GPC) employing tetrahydrofuran (THF) as the solvent is useful. Namely, 1.0 mg of THF is added to 0.5 to 5 mg, concretely 1 mg, of the sample and stirred by a magnetic stirrer to sufficiently dissolve the sample. After that, the solution is treated by a membrane filter with a pore size of from 0.45 to 0.50 μm and injected into GPC.

The Measuring conditions of the GPC are as follows: the column is stabilized at 40° C., and THF lets flow in a rate of 1.0 ml per minute, then 100 μl of the sample in a concentration of 1 mg/ml is injected for measurement. A combination of polystyrene gel columns available on the market is preferably employed as the column. For example, a combination of Shodex GPC KF-801, 802, 803, 804, 805, 806 and 807, each manufactured by Showa Denko Co., Ltd., and a combination of TSK gel G1000H, G2000H, G3000, G4000, G5000, G6000, G7000 and TSK guard gel column, each manufactured by Toso Co., Ltd., are usable. As the detector, a refractive detector (IR detector) or UV detector is useful. In the molecular weight measurement of the sample, the molecular weight distribution of the sample is calculated by a calibration curve prepared by using monodispersed polystyrene standard particles. It is suitable to employ about ten kinds of the polystyrene particles for preparing the calibration curve.

(Aggregating Agent)

In a process to salt-out/fuse resin particles from a dispersion liquid of resin particles prepared in water base media, although a metal salt may be used desirably as an aggregating agent, it is still more desirable to use a divalent or tervalent metal salt as an aggregating agent. The reason is that since the critical aggregation concentration (an aggregation value or an aggregation point) is smaller, the divalent or tervalent metal salt is more desirable than a monovalent metal salt.

Concrete examples of the aggregating agent are as follows. As the mono-valent metal salt, sodium chloride, potassium chloride and lithium chloride, as the di-valent metal salt, calcium chloride, zinc chloride, copper sulfate, magnesium sulfate and manganese sulfate, and as tri-valent metal salt, aluminum chloride and iron chloride are cited.

The critical aggregation concentration is an index of the stability of dispersion in an aqueous medium, which is the concentration of the aggregating agent at the starting of aggregation when the aggregating agent is added to the dispersion. The critical aggregation concentration is largely varied depending on the latex itself and the kind of the aggregating agent. For example, S. Okamura et al. "Koubunshi Kagaku (Polymer Chemistry)", 17, 601, 1960 describes in detail about the critical aggregation concentration, the value of that can be known by this publication.

In another method, the designated salt is added in various concentrations to the subjective particle dispersion and z-potential of the dispersion is measured. The critical aggregation concentration can be determined by the concentration of the salt at which beginning variation of the z-potential is observed.

It is preferable to process polymer particulate dispersion liquid by using a metal salt so that a concentration becomes more than a critical aggregation concentration.

It is preferable to add such that the concentration of a metal salt may become 1.5 or more times of critical aggregation concentration, more preferably to become 2.0 or more times.

Further, another manufacturing method of toner will now be explained.

A manufacturing method of toner utilizable in this invention also may be one provided with a process in which a binder resin, a colorant and a releasing agent are dissolved or dispersed in a solvent to prepare a toner composition mixture solution (hereinafter, referred to as "a mixing process"), a dispersing suspension process in which the prepared toner composition mixture solution is added in a water-based medium and dispersing suspended to prepare a toner composition dispersing suspension (hereinafter, referred to as "a dispersing suspension process") and a process in which a solvent is eliminated from the prepared toner composition dispersing suspension (referred to as "a solvent elimination process"). Each of these processes will be explained successively.

(Mixing Process)

A mixing process is a process in which at least a binder resin, a colorant and a releasing agent are dissolved or dispersed in a solvent to prepare a toner composition mixture solution.

In a mixing process, additives such as a dispersant for a colorant and a charging controlling agent, which are generally added in toner particles, may be appropriately added other than a binder resin, a colorant and a releasing agent.

In a mixing process, a binder resin in which a colorant, a releasing agent, and appropriately with other additives having been kneaded in advance, is dissolved or dispersed in a solvent, or a colorant and appropriately other additives are dissolved or dispersed after a binder resin has been dissolved in a solvent. Further, a dissolving or dispersing method includes a method utilizing, for example, a medium containing homogenizer such as a ball mill and a sand mill or a high pressure homogenizer.

A binder resin to constitute toner may be any of those soluble in a solvent among thermoplastic resin and includes, for example, a styrene-acryl copolymer, a polyester resin, a ketone resin, an epoxy resin, a polyolefin resin and other commonly known thermoplastic resins utilized as a binder resin of color toner for development of an electrostatic image. A dispersant for a colorant is not specifically limited and includes those commonly known conventionally.

As a releasing agent, preferably utilized are those having a melting point of 40-75° C. such as stearyl stearate and behenyl behenate described before.

A charge controlling agent includes a quaternary ammonium salt compound in addition to those commonly known as a charge controlling agent of color toner for development of an electrostatic charge.

A solvent includes ester type solvents such as methyl acetate, ethyl acetate, propyl acetate and butyl acetate; ether type solvents such as diethyl ether, dibutyl ether and dihexyl ether; ketone type solvents such as methyl ethyl ketone, methyl isopropyl ketone, methyl isobutyl ketone and cyclohexanone; hydrocarbon type solvents such as toluene, xylene and hexane; and hydrocarbon halogenide type solvents such as dichloromethane, chloroform and trichloroethylene. These solvents are preferably ones which can dissolve a resin binder as well as having a ratio of being dissolved in water of around 0-30 weight %. Further, in consideration of such as safety in operation, cost and productivity on industrialization, it is specifically preferable to utilize cyclohexane in the case of a binder resin being polyolefin, and ethyl acetate in the case of other binder resins. These solvents are preferably utilized so as to make the viscosity of a toner composition mixture solution at 20° C. in a range of 1-10000 mPa·s and preferably 1-2000 mPa·s.

(Dispersing Suspension Process)

A dispersing suspension process is a process in which a toner composition mixture solution prepared in a mixing process is added in a water-based medium and dispersing suspended to prepare a toner composition dispersing suspension.

In a dispersing suspension process, by setting a temperature of a toner composition dispersing suspension to 5-35° C., prepared can be toner particles, in which a colorant and a releasing agent are uniformly dispersed, without aggregation in toner particles or localization on the outside surface of toner particles, of a colorant. Further, it has been confirmed that a particle size distribution of the obtained toner particles becomes sharp.

The temperature of a toner composition dispersing suspension is controlled by adjusting temperatures of a toner composition mixture solution and a water-based medium utilized.

Further, in a dispersing suspension process, the temperature change during the start to the end of dispersing suspension is necessary to be depressed within 10° C., preferably within 5° C. and more preferably within 3° C. The particle size distribution reaches a steady state by keeping the temperature change within the above range, resulting in exhibition of a definite reproducibility. Herein, the temperature change of a toner composition dispersing suspension during the start to the end of dispersing suspension indicates the difference between the highest temperature and the lowest temperature of a toner composition dispersing suspension during the start to the end of dispersing suspension.

Further, with respect to the temperature change of a toner composition dispersing suspension during the start to the end of dispersing suspension, since utilization of an emulsifier or a homogenizer at the time of dispersing suspension accompanies heat emission, it is preferable to control the temperature by means of forced cooling employing such as refrigerant. In particular, it has been confirmed that cooling with refrigerant of not more than 20° C. is effective to maintain the temperature difference within 10° C. in the case of utilizing an emulsifier or a homogenizer which provide high shearing. Specific refrigerant includes industrial water such as tap water and well water. The industrial water is improved in refrigerant function by addition of such as ethylene glycol, and is possible to be cooled down to lower than 0° C. Further, refrigerant is preferably maintained at a constant temperature.

As a water-based medium utilized in a dispersing suspension process, water in which an inorganic dispersant is dispersed is preferred. Further, to make the particle size distribution of toner particles uniform, it is preferable to add a polymer dispersant, which is soluble in water, together with an inorganic dispersant being dispersed in water. Herein, water utilized in a dispersing suspension process is preferably ion-exchanged water, distilled water or pure water.

An inorganic dispersant is preferably a hydrophilic dispersant and specifically includes silica, alumina, titania, calcium carbonate, magnesium carbonate, tricalcium phosphate, clay, diatomaceous earth and bentonite. Among them, specifically preferable is calcium carbonate. Further, an inorganic dispersant is preferably one the particle surface of which is covered with a polymer provided with a carboxyl group with respect to manufacturing of stable toner particles. Such a polymer provided with a carboxyl group is preferably one having a number average molecular weight of 1000-200000, and, includes such as acrylic acid type resin, methacrylic acid type resin, fumaric acid type resin and maleic acid type resin, as typical examples. Also utilized can be a homopolymer of such as acrylic acid, methacrylic acid, fumaric acid and maleic acid which are monomers to constitute aforesaid resins, copolymers thereof in addition to copolymers thereof with other vinyl monomers. Further, the carboxyl group may form a metal salt of such as sodium, potassium or magnesium.

A mean particle diameter of an inorganic dispersant is preferably 1-1000 nm and more preferably 5-500 nm. Further, a using amount of an inorganic dispersant is in a range of 1-500 weight parts and preferably in a range of 10-200 weight parts, based on 100 weight parts of toner. Further, an inorganic dispersant is preferably dispersed in water by use of a homogenizer containing a medium such as a ball mill, a high pressure homogenizer or an ultrasonic homogenizer.

A polymer dispersant utilized in a dispersing suspension process is preferably hydrophilic, and, among those provided with a carboxyl group, specifically preferable are those having no hydrophobic groups such as a hydroxypropyl group and a methoxypropyl group. Specific polymer dispersants include water-soluble celluloses such as carboxymethyl cellulose and carboxyethyl cellulose and carboxymethyl cellulose is specifically preferred among them. These celluloses preferably have an etherification degree of 0.6-1.0 and a mean polymerization degree of 50-3000. Further, a carboxyl group may be a metal salt of such as sodium, potassium or magnesium. The addition of a polymer dispersant has the most suitable amount depending on the viscosity of a toner composition mixture solution, and utilization at the most suitable range enables to control a particle size distribution of the formed toner particles to be sharper. That is, a polymer dispersant is added so as to adjust a viscosity of a water-based medium at 20° C. to approximately 1-3000 mPa·s and preferably 1-1000 mPa·s. Further, a polymer dispersant may be added by any method provided that it is uniformly dissolved in water.

Dispersing suspension in a dispersing suspension process is performed by use of an emulsifier or a homogenizer commonly available on the market, however, is preferably performed by use of an emulsifier or a homogenizer provided with a rotary fan. Such an emulsifier or a homogenizer includes, for example, batch type emulsifiers such as Ultratalux (produced by IKA Co., Ltd.), Polytron (produced by Kinematica Co., Ltd.), TK Autohomomixer (produced by Tokushu Kikakogyo Co., Ltd.) and National Cooking Mixer (produced by Matsushita Electric Industrial Co., Ltd.); continuous type emulsifiers such as Ebara Milder (produced by Ebara Corp.), TK Pipe-line Homomixer, TK Homomic Lineflow, TK Fillmix (produced by Tokushu Kikakogyo Co., Ltd.), Colloid Mill (produced by Shinko Pantec Co., Ltd.), Slusher, Trigonal Wet-type Micro-grinder (produced by Mitsui-Miike Kakoki Co., Ltd.), Cavitron (produced by Eurotech. Co., Ltd.) and Fine Flow-mill (produced by Taiheiyo. Kiko Co., Ltd.); and both ways of batch or continuous type emulsifiers such as CLEAMIX (produced by M Techinique Co., Ltd.).

In a dispersing suspension process, when dispersing suspension is performed by use of an emulsifier r a homogenizer provided with a rotary fan, a circumferential speed of a rotary fan is preferably not less than 15 m/s. It has been confirmed that toner of small particle diameter, which has a sharp toner size distribution, can be prepared under a stable manufacturing condition by performing dispersing suspension at this circumferential speed to control a mean particle diameter or a particle size distribution of the toner.

The process conditions of a dispersing suspension process may be controlled by means of monitoring as described above. That is, a measurement device is installed in an apparatus to form dispersing suspension such as Ultratalux, and dispersing suspension operation is performed while measurement is made. It has been confirmed that toner particles having a median diameter by number D50 of 3.0-5.0 μm and a mean circularity of 0.975-1.000 can be obtained when dispersing suspension is performed by setting a circumferential speed of the rotary fan of a homogenizer at not less than 15 m/sec as described above. Further, it has been also confirmed that there is a tendency of the particle diameter to decrease as well as the mean circularity to approach 1.000, by setting a rotating speed higher. Further, the particle diameter becomes small as well as the mean circularity approaches to 1.000 as the dispersing suspension time is prolonged at a constant circumferential speed, however, there is a tendency of increase of the particle diameter, in turn, due to increased collision of particles each other when dispersing suspension time is too long.

A specific method of monitoring includes a method in which a toner composition mixture solution, which has been stirred, for example, in a stirring device of Ultratalux to be made as liquid droplets, is passed through Flow-type Particle Image Analyzer FPIA (produced by Toa Medical Electronics Co., Ltd.) described above followed by real-time image processing to monitor a particle size and shape. FIG. 6 is a schematic view of a dispersing suspension apparatus capable of monitoring utilized in a dispersing suspension process, and which is constituted of dispersing suspension apparatus 5 which practically performs dispersing suspension and Flow-type Particle Image Analizer 6 which performs monitoring, as shown in FIG. 6(*a*). Further, FIG. 6(*b*) is a stirring device utilized in dispersing suspension apparatus 5.

As shown in FIG. 6(*a*), toner composition mixture solution TM is supplied into stainless vessel 52 which performs dispersing suspension from toner composition mixture solution outlet 512 through toner composition mixture solution supplying tube 53. At this time, toner composition mixture solution TM is made into particles by passing through a gap formed between stirring fan 511 and gap forming part 513 which constitute stirring device 51 in a state of stirring operation. Flow-type Particle Image Analyzer 6, which is constituted of analyzer 61 and personal computer 62, is connected with detecting portion 63 comprising a sensor arranged in stainless vessel 52 via cable 64. Detecting portion 63 performs monitoring by detecting the state of particles in toner composition dispersing suspension TR.

(Solvent Elimination Process)

A solvent elimination process is a process to eliminate a solvent from a toner composition dispersing suspension prepared by a dispersing suspension process. By this process, a toner composition dispersing suspension is separated into a dispersion containing a toner composition and a dispersion containing additives such as an inorganic dispersant.

In a solvent elimination process, solvent elimination of toner dispersing suspension may be performed immediately after a dispersing suspension process, however, solvent elimination is preferably performed after the solution having been stirred for 1-60 minutes after finishing a dispersing suspension process to stabilize the particle size distribution in view of making a particle size distribution of obtained toner particles more uniform.

In a solvent elimination process, solvent contained in droplets of a toner composition dispersing suspension is preferably eliminated by cooling or heating the toner composition dispersing suspension at 0-100° C. As a specific method of the solvent elimination, preferably performed by either one method of (1) or (2) described below.

(1) A stream of air is blown to a toner composition dispersing suspension to forcedly refresh the air phase on the suspension surface. In this case, a gas may be bubbled into the suspension.

(2) A toner composition dispersion is subjected to a reduced pressure of 1.33-101.3 kPa. In this case, a gas phase on the suspension surface may be forcedly refreshed by a gas purge and further a gas may be bubbled into the suspension.

(Other Processes)

The toner manufacturing method is appropriately provided with a washing and dehydration process and a drying and sieving process, which will be explained below.

A washing and dehydration process is a process in which after a water-based medium is from the toner dispersion obtained by a solvent elimination process, the resulting product is washed and dehydrated to prepare a toner cake.

In this washing and dehydration process, toner dispersion obtained by a solvent elimination process is preferably subjected to acidic treatment to dissolve an inorganic dispersant followed by being dehydrated by washing with water. Herein, alkaline treatment may be added after the acid treatment.

A drying and sieving process is a process to dry and sieve as well as to add external additives after a toner cake, obtained by a washing and dehydration process, has been dried, resulting in preparation of toner. In this drying process, drying, sieving and external additive addition can be performed by any method provided that toner does not cause aggregation or crush by the method.

(Colorant)

The toner according to the invention can be obtained by salting out/fusing the above-mentioned composite resin particles and the colorant particles.

Various inorganic pigments, organic pigments and dyes can be cited as the colorant (colorant particles subjected to salting out/fusing with composite resin particles) constituting toner.

Usually known inorganic pigments are employable.

Concrete examples of the inorganic pigment are described below.

For example, carbon black such as furnace black, channel black, acetylene black, thermal black and lamp black, and magnetic powder such as magnetite and ferrite are employable as the black pigment.

These inorganic pigments can be employed solely or in a combination of plural kinds thereof. The adding amount of the pigment is from 2 to 20 mass %, and preferably from 3 to 15 mass %, by weight of the polymer.

In case that it is used as magnetic toner, the above-mentioned magnetite can be added. In this case, from a viewpoint of providing a predetermined magnetic property, it is desirable to add the above-mentioned magnetite by 20-60 mass % in toner.

Usually known organic pigments and dyes can be employed; concrete organic pigments and dyes are listed below.

As the pigments for magenta or red color, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222 may be employed.

The pigments for orange or yellow color are, for example, C.I. Pigment Orange 31, C.I. Pigment Orange 43, C. I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155 and C.I. Pigment Yellow 156.

Pigments for green or blue color are, for example, C.I. Pigment Blue 15, C.I. Pigment Blue 15:2, C.I. Pigment Blue 15:3, C.I. Pigment Blue 16, C.I. Pigment Blue 60 and C.I. Pigment Green 7.

Dyes, for example, C.I. Solvent Reds 1, 49, 52, 63, 111 and 122, C.I. Solvent Yellows 19, 44, 77, 79, 81, 82, 93, 98, 103, 104, 112 and 162, and C.I. Solvent Blues 25, 36, 60, 70, 93 and 95 are employable. A mixture of them can be also employable.

These organic pigments can be employed solely or in a combination of plural kinds thereof. The adding amount of the pigment is from 2 to 20%, and preferably from 3 to 15%, by weight of the polymer.

In the toner to be used in the invention, various kinds of charge controlling agent can be employed. The charge controlling agent is not specifically limited as long as the agent can be dispersed in water. Concrete examples of the charge controlling agent include nigrosine type dyes, metal salts of naphthenic acid or high fatty acid, alkoxylated amines, quaternary ammonium compounds, azo type metal complexes, metal salts of salicylic acid and its metal complexes.

The charge controlling agent is preferably made in a dispersed state having a number average primary particle diameter of from 10 to 500 nm.

In the toner to be used in the invention, an external additive may be added to the toner particles and adhered onto the toner surface by high speed stirring. By adhesion of the external additive on the toner particle surface, a better image can be obtained.

As the external additive, an inorganic particle or an organic particle may be employed, but the external additive is not limited to them.

Inorganic particles such as silica, titania and alumina are preferred as the inorganic particle. In concrete, the silica fine particle such as R-805, R-976, R-974, R-972, R-812 and R-809 each manufactured and marketed by Nihon Aerogel Co., Ltd., HVK-2150 and H-200 manufactured by Hoechst Co., Ltd., TS-720, TS-530, TS-610, H-5 and MS-5 each manufactured and marketed by Cabot Co., Ltd., are cited.

As the titan fine particle, for example, T-805 and T-604 each manufactured and marketed by Nihon Aerogel Co., Ltd., MT-100S, MT-100B, MT-500BS, MT-600, MT-600SS and JA-1 each manufactured and marketed by Teica Co., Ltd., TA-300SI, TA-500, TAF-130, TAF-510 and TAF-510T each manufactured and marketed by Fuji Titan Co., Ltd., and IT-S, IT-OA, IT-OB and IT-OC manufactured and marketed by Idemitsu Kosan Co., Ltd., are cited.

As the alumina fine particle, for example, RFY-C and C-604 each manufactured and marketed by Nihon Aerogel Co., Ltd., and TTO manufactured and marketed by Ishihara Sangyo Co., Ltd., are cited.

These inorganic fine particles are preferably subjected to a hydrophobilizing treatment by a silane coupling agent or a silane coupling agent. Though the degree of the hydrophobilizing treatment is not specifically limited, a methanol wettability of from 40 to 95 is preferable.

The methanol wettability indicates the easiness of wetting to methanol. The method of measurement of the methanol wettability is as follows: 0.2 g of the organic fine particles to be measured is added into 50 ml of distillated water put in a 200 ml beaker. Methanol is gradually added from a bullet, the lower end of which is immersed in the liquid, to the liquid until the inorganic particles are entirely wetted while slowly stirred. When the amount of methanol necessary for completely wetting the organic fine particles is "a" in ml, the hydrophobicity is calculated according to the following equation.

$$\text{Hydrophobicity (\%)}=[a/(a+50)]\times 100$$

Further, spherical organic fine particles having a number average primary particle diameter of from 10 to 2,000 nm can be employed as the organic fine particles.

In concrete, styrene resin fine particles, styrene-acryl resin fine particles, polyester resin fine particles and urethane resin fine particles are preferably employable.

The adding amount of the external additive is preferably from 0.1 to 5.0%, and more preferably from 0.5 to 4.0%, by weight of the toner. Plural kinds of the exterior additive may be employed in combination.

Usually known various kinds of mixer such as a tabular mixer, a Henschel mixer, a nauter mixer and a V type mixer are applicable as the adding method of the external additive.

(Developer)

The toner according to the invention may be either employed as a single-component developer or double-component developer. When the toner is employed as the single-component developer, the toner is applicable for both of a non-magnetic single-component developer and a magnetic single-component developer in which magnetic particles of from 0.1 to 0.5 μm are contained in the toner particle.

The toner may be employed as the double-component developer by mixing with a carrier. In such the case, usually known materials such as metal such as iron, ferrite and magnetite, an alloy of the metal with aluminum or lead can be employed as the magnetic particle of the carrier.

Particularly, ferrite particle is preferable. The magnetic particle is preferably one having a volume average particle diameter (D4) of from 15 to 100 μm, and more preferably from 25 to 80 μm.

The measurement of the volume average particle diameter (D4) can be performed by a laser diffraction particle size distribution measuring apparatus HELOS, manufactured by Sympatec Co., Ltd., having a wet type dispersion means.

As the carrier, a magnetic particle coated with resin and resin dispersed type carrier composed of magnetic particles dispersed in the resin are preferred. Though the resin composition for coating is not specifically limited, for example, olefin type resins, styrene type resins, styrene-acryl type resins, silicone type resins, ester type resins or fluorine-containing polymer type resins are employable. As the resin for constituting the resin dispersed type carrier, known ones can be employed without any limitation, for example, styrene-acryl type resins, polyester resins, fluorinated type resins and phenol resins are usable.

EXAMPLES

The present invention is described in detail below referring examples; the embodiment of the invention is not limited to the examples.

Example A

Producing Example 1 of Toner Particles (Example 1 of an Emulsion Polymerization Method)

[Latex 2HML]

(1) Preparation of nucleus particle (the first step of polymerization): In a 5000 ml separable flask with which a stirring device, a temperature sensor, a cooling tube, and a nitrogen introduction device were attached, a surfactant solution (water base media) in which anion surfactant ((101) $C_{10}H_{21}(OCH_2CH_2)_2OSO_3Na$) 7.08 g was dissolved in 3010 g of ion exchanged water was prepared. Under the nitrogen air current, the temperature in a flask was raised to 80° C., agitating a surfactant solution at the stirring velocity of 230 rpm.

To the surfactant solution, an initiator solution composed of 9.2 g of polymerization initiator (potassium persulfate: KPS) dissolved in 200 g of deionized water and the temperature was adjusted to 75° C. After that, a monomer mixture composed of 70.1 g of styrene, 19.9 g of n-butyl acrylate and 10.9 g of methacrylic acid is dropped to the liquid spending for one hour, and the system was heated and stirred for 2 hours at 75° C. to perform polymerization (the first step polymerization). Thus latex (a dispersion of particles of a high molecular weight resin) was preferred. The latex was referred to as Latex 1H.

(2) Formation of intermediate layer (the second step polymerization): In a flask having a stirring device, 98.0 g of the compound represented by the foregoing Formula 19, hereinafter referred to as Exemplified Compound 19, was added to a monomer mixture liquid composed of 105.6 g of styrene, 30.0 g of n-butyl acrylate, 6.2 g of methacrylic acid and 5.6 g of n-octyl 3-mercaptopropionate and dissolved by heating by 90° C. to prepare a monomer solution.

On the other hand, the surfactant solution in which 1.6 g of an anion surfactants (the above-mentioned formula (101)) was dissolved in 2700 ml of ion exchanged water was heated to 98° C., after adding the above-mentioned latex (1H) which is a dispersion liquid of a nuclear particle by 28 g in terms of solid content conversion in this surfactant solution, a monomer solution of the above-mentioned stearyl stearate was mixed and dispersed for 8 hours by a mechanical dispersing device "CLEAMIX (CLEARMIX)" (manufactured by M Technique Co., Ltd.) which has a circulation pathway, thereby a dispersion liquid (emulsified liquid) containing emulsified particles (oil particle) was prepared.

And then 750 ml of deionized water and an initiator solution composed of 5.1 g of the initiator (KPS) and 240 ml deionized water were added, and this system was heated and stirred for 12 hours at 98° C. to perform polymerization (the second step polymerization). Thus latex (a dispersion of composite resin particles each composed of the resin particle of high molecular weight resin covered with medium molecular weight resin on the surface thereof was obtained. This latex was referred to as Latex 1HM.

When Latex (1HM) was dried and observed by a scanning electron microscope, particles (400 to 1000 nm) principally composed of stearyl stearate not surrounded by the latex were observed.

(3) Formation of Outer Layer (the Third Step Polymerization)

To Latex 1HM obtained as above, an initiator solution composed of 7.4 g of the initiator (KPS) dissolved in 200 ml of deionized water was added, and a monomer mixture liquid composed of 300 g of styrene, 95 g of n-butyl acrylate, 15.3 g of methacrylic acid and 10.4 g of n-octyl 3-mercaptopropionate was dropped spending 1 hour at a temperature of 80° C. After completion of the dropping, polymerization (the third step polymerization) was performed by heating and stirring for 2 hours and then cooled by 28° C. to obtain latex (a dispersion of composite resin particles each composed of a central portion of the high molecular weight resin, an intermediate layer of the medium molecular weight resin and containing stearyl stearate and an outer layer of the low molecular weight resin). The latex was referred to as Latex 1HML.

The composite resin particle constituting Latex 1HML had peaks of the molecular weight distribution at 138,000, 80,000 and 13,000, and the weight average particle diameter of the composite resin particles was 122 nm.

Moreover, in that of the production process of Latex 1HML, Latex 2HML was produced with the same procedure except that myristyl stearate (melting point 40° C.) was used 99.0 g as a releasing agent instead of stearyl stearate, Latex 3HML was produced with the same procedure except that behenyl behenate (melting point 75° C.) was used 97.0 g as a releasing agent instead of stearyl stearate, and Latex 4HML was produced with the same procedure except that distyryl ketone (melting point 88° C.) was used 95.5 g as a releasing agent instead of stearyl stearate.

It was confirmed that each composite resin particles which constitute the produced Latex 2HML-4HML has the same peak molecular weight and mass average particle diameter of the composite resin particles which constitute Latex 1HML.

Producing Example of toner particles [production of toner particles 11BK-18BK and comparative toner particles 11BK-comparison 15BK].

To 1,600 ml of deionized water, 59.0 g of anionic surfactant 101 was dissolved by stirring, 420.0 g of carbon black Regal 330, manufactured by Cabot CO., ltd., was gradually added to the above solution while stirring, and then dispersed by CLEAMIX, manufactured by M•Technic CI., Ltd., to prepare a dispersion of colorant particles. The colorant dispersion was referred to as Colorant Dispersion 1Bk. The weight average of the colorant particles in the colorant dispersion was 89 nm by measurement using an electrophoretic light scattering photometer ESL-800 manufactured by Ootsuka Denshi Co., Ltd.

Next, resin particles and colorant particles were aggregated with the following procedure, employing Colorant Dispersion 1Bk and Latex 2HML.

In a reaction vessel (a four-mouth flask) to which a thermal sensor, a cooler, a nitrogen introducing device and a stirrer were attached, 420.7 g in terms of solid component of Latex 1HML, 900 g f deionized water and 166 g of Colorant Dispersion 1Bk were charged and stirred. After adjusting the temperature in the vessel to 30° C., the pH of the liquid was adjusted to 8 to 10 by adding a 50 mol/L aqueous solution of sodium hydroxide. After that, a solution of 12.1 g of magnesium chloride hexahydrate in 1,000 ml of deionized water was added to the above liquid spending 10 minutes at 30° C.

After standing for 3 minutes, the temperature of this system was raised by 90° C. spending 6 to 60 minutes to form associated particles (aggregation process). In the state, the particle size of association particles was measured by "Coulter counter TA-II", and at the time that the median size D50 of a number basis became 2.5-4.0 μm, the aqueous solution which dissolved 40.2 g of sodium chloride in 1000 ml of ion exchanged water is added so as to stop grain growth.

Furthermore, fusion of particles and phase separation of a releasing agent were made to continue by carrying out heating stirring as a ripening process over 6 hours at 98° C. of the solution temperature (ripening process).

The produced association particles were filtered and washed with 45° C. ion exchanged water repeatedly, thereafter dried with 40° C. warm air. Then, toner particles 11BK-16BK, and comparative toner particles 11BK-13BK which were the toner particles containing stearyl stearate as a releasing agent were obtained. Moreover, toner particle 17BK which contains myristyl myristate as a releasing agent was obtained using Latex 2HML and colorant dispersion liquid 1BK, toner particle 18BK and comparative toner particles 15BK which contain behenyl behenate as a releasing agent were obtained using Latex 3HML and colorant dispersion liquid 1BK.

Furthermore, comparative toner particles 14BK which contains distyryl ketone as a releasing agent was obtained using Latex 4HML and colorant dispersion liquid 1BK.

[Production of Toner Particles 11Y-18Y and Comparative Toner Particles 11Y-15Y]

Ninety grams of anionic surfactant 101 was dissolved by stirring in 1,600 ml of deionized water. To the solution, 420 g of pigment, C.I. Solvent Yellow 93, was gradually added while stirring and dispersed by a stirring apparatus CLEAMIX, manufactured by M•Technic Co., Ltd., to prepare a dispersion of the colorant particles. The dispersion was referred to as Colored Dispersion Liquid 1Y. The average particle diameter in Colored Dispersion Liquid 1Y measured by an electrophoretic light scattering photometer ELS-800, manufactured by Ootsuka Denshi Co., Ltd., was 250 nm in weight average particle diameter.

Toner Particles 11Y through 18Y and Comparative Toner Particles 11Y through 15Y were each prepared in the same manner as in Toner Particles 11Bk through 18Bk and Comparative Toner Particles 11Bk through 15Bk, respectively, except that 168 g of Colorant. Dispersion Liquid 1Y was employed in place of 166 g of Colorant Dispersion Liquid 1Bk.

[Production of Toner Particles 11M-18M and Comparative Toner Particles 11M-15M]

Ninety grams of anionic surfactant 101 was dissolved by stirring in 1,600 ml of deionized water. To the solution, 420 g of pigment, C.I. Pigment Red 122, was gradually added while stirring and dispersed by a stirring apparatus CLEAMIX, manufactured by M•Technic Co., Ltd., to prepare a dispersion of the colorant particles. The dispersion was referred to as Colored Dispersion 1M. The average particle diameter in Colored Dispersion 1M measured by an electrophoretic light scattering photometer ELS-800, manufactured by Ootsuka Denshi Co., Ltd., was 250 nm in weight average particle diameter.

Toner Particles 11M through 18M and Comparative Toner Particles 11M through 15M were each prepared in the same manner as in Toner Particles 11Bk through 18Bk and Comparative Toner Particles 11Bk through 15Bk, respectively, except that 166 g of Colorant. Dispersion 1M was employed in place of 166 g of Colorant Dispersion 1Bk.

[Production of Toner Particles 11C-18C and Comparative Toner Particles 11C-15C]

Ninety grams of anionic surfactant 101 was dissolved by stirring in 1,600 ml of deionized water. To the solution, 400 g of pigment, C.I. Pigment Blue 15:3, was gradually added while stirring and dispersed by a stirring apparatus CLEAMIX, manufactured by M•Technic Co., Ltd., to prepare a dispersion of the colorant particles. The dispersion was referred to as Colored Dispersion 1C. The average particle diameter in Colored Dispersion 1C measured by an electrophoretic light scattering photometer ELS-800, manufactured by Ootsuka Denshi Co., Ltd., was 250 nm in weight average particle diameter.

Toner Particles 11C through 18C and Comparative Toner Particles 11C through 15C were each prepared in the same manner as in Toner Particles 11Bk through 18Bk and Comparative Toner Particles 11Bk through 15Bk, respectively, except that 98.7 g of Colorant Dispersion 1C was employed in place of 166 g of Colorant Dispersion 1Bk.

Example 2 of Toner Particle Manufacturing
(Example 2 of Emulsifying Association Method)

(Preparation of Resin Particle Dispersion)

Styrene of 370 g, n-butyl acrylate of 30 g, acrylic acid of 8 g, dodecanethiole of 24 g and carbon tetrabromide of 4 g were mixed and dissolved, the resulting solution was emulsion polymerized in a flask, in which 6 g of a nonionic surfactant "nonylphenylether" and 10 g of an anionic surfactant "sodium dodecylbenzene sulfonate" had been dissolved in 550 g of ion-exchanged water, and 50 g of ion-exchanged water, in which 4 g of ammonium persulfate were dissolved, were added therein while being slowly stirred for 10 minutes. After nitrogen displacement, the content was heated with an oil-bath to reach 70° C. while the inside of the above-described flask was being stirred, and emulsion polymerization was continued as it is for 5 hours. As a result, prepared was "resin micro-particles dispersion 2", in which resin particles, having a volume average particle diameter=150 nm, a glass transition temperature=58° C. and a weight average molecular weight=11500, were dispersed. The solid content of this dispersion was 40 weight %.

(Preparation of Colorant Dispersion 2BK)

| | |
|---|---|
| Colorant (carbon black) "Regal 330" | 64 weight parts |
| Nonionic surfactant "nonylphenyl ether" | 5 weight parts |
| Ion-exchanged water | 240 weight parts |

The above components were mixed and dissolved, followed by being stirred by use of Homogenizer "Ultratlux T50" (produced by IKA Co., Ltd.) for 10 minutes, and the resulting solution was subjected to a dispersion process with Ultimizer resulting in preparation of colorant dispersion in which colorant particles having a weight average particle diameter of 250 nm were dispersed. This colorant dispersion was bubbled with air for 5 minutes to prepare "colorant dispersion 2Bk".

(Preparation of Colorant Dispersion 2Y)

"Colorant dispersion 2Y", comprising colorant particles having a weight average particle diameter of 250 nm being dispersed, by the same procedure, except that 67 parts of a dye (C.I. Solvent Yellow 93) were utilized instead of 64 weight parts of colorant (carbon black) "Regal 330" in "colorant dispersion 2BK".

(Preparation of Colorant Dispersion 2M)

"Colorant dispersion 2M" was prepared by the same procedure, except that 65 parts of a dye (C.I. Solvent Red 22) were utilized instead of 64 weight parts of colorant (carbon black) "Regal 330" in "colorant dispersion 2BK" and the prepared colorant dispersion was subjected to a treatment by air for 10 minutes. The weight average particle diameter of the obtained colorant was 250 nm.

(Preparation of Colorant Dispersion 2C)

"Colorant dispersion 2C" was prepared by the same procedure, except that 64 parts of a dye (C.I. Solvent Blue 15:3) were utilized instead of 64 weight parts of colorant (carbon black) "Regal 330" in "colorant dispersion 2BK" and the prepared colorant dispersion was subjected to a treatment by air for 10 minutes. The weight average particle diameter of the obtained colorant was 250 nm.

(Preparation of Releasing Agent Dispersion 2V)

| | |
|---|---|
| Behenyl behenate (melting point of 75° C.) | 100 weight parts |
| Cationic surfactant "alkyl ammonium salt" | 5 weight parts |
| Ion-exchanged water | 240 weight parts |

The above components were dispersed in a cubic stainless steel flask by use of Homogenizer "Ultratalux T50" (produced by IKA Co., Ltd) for 10 minutes followed by being dispersed by a pressure ejection type homogenizer, resulting in preparation of "releasing agent dispersion 2V" comprising releasing agent particles having a volume average particle diameter of 550 nm being dispersed.

(Preparation of Releasing Agent Dispersion 2W)

"Releasing agent dispersion 2W" comprising dispersed releasing agent particles having a volume average particle diameter of 580 nm was prepared by the same procedure, except that 98 weight parts of myristyl myristate (melting point of 40° C.) were utilized instead of 100 weight parts of behenyl behenate in the above "releasing agent dispersion 2V".

(Preparation of Releasing Agent Dispersion 2X)

"Releasing agent dispersion 2X" comprising dispersed releasing agent particles having a volume average particle diameter of 545 nm was prepared by the same procedure, except that 101 weight parts of stearyl stearate (melting point of 58° C.) were utilized instead of 100 weight parts of behenyl behenate in the above "releasing agent dispersion 2V".

(Preparation of Releasing Agent Dispersion 2Z)

"Releasing agent dispersion 2Z" comprising dispersed releasing agent particles having a volume average particle diameter of 550 nm was prepared by the same procedure, except that 99 weight parts of paraffin wax (melting point of 97° C.) were utilized instead of 100 weight parts of behenyl behenate in the above "releasing agent dispersion 2V".

(Preparation of Toner Particles 21BK-28BK and Comparison 21BK-Comparison 24BK)

| | |
|---|---|
| Resin micro-particle dispersion 2 | 234 weight parts |
| Colorant dispersion 2BK | 30 weight parts |
| Releasing agent dispersion 2W | 40 weight parts |
| Poly(aluminum chloride) | 1.8 weight parts |
| Ion-exchanged water | 600 weight parts |

The above components were mixed and dispersed in a cubic stainless steel flask by use of Homogenizer "Ultratalux T50" (manufactured by IKA Co., Ltd), followed by being heated in a heating oil bath up to 55° C. while stirring the inside of the flask to start aggregation of resin micro-particles, a colorant and a releasing agent. Successively, 32 weight parts of "resin micro-particle dispersion 2" were added in the dispersion having been kept in a vessel at 55° C., and aggregation was continued while being kept at 55-56° C. for 30 minutes to 2.5 hours. After a sodium hydroxide solution was added to adjust the pH of the system to 5.0, the stainless steel flask was sealed by use of a magnetic seal and heated up to 95° C. with continuous stirring to be kept for 1-6 hours. Then the prepared toner particles are washed with ion-exchanged water of 45° C., followed by being dried with a warm air stream of 40° C., resulting in preparation of toner particles 21BK-26BK and comparison 21BK-comparison 24BK.

(Preparation of Toner Particles 27BK, 28BK and Comparison 25BK)

Toner particles 27Bk was prepared by the same procedure as the preparation method of above toner particles 21BK-26BK and comparisons 21BK-24BK, except that "releasing agent dispersion 2W" was utilized instead of "releasing agent dispersion 2V", and similarly toner particles 28BK employing "releasing agent dispersion 2X" and comparison 25BK employing "releasing agent dispersion 2Z", respectively.

(Preparation of Toner Particles 21Y-28Y and Comparison 21Y-Comparison 25Y)

Toner particles 21Y-28Y and comparison 21BK-comparison 25Y were prepared according to the same procedure as the preparation method of above toner particles 21BK-28BK and comparison 21BK-comparison 25BK, except that "colorant dispersion 2Y" was utilized instead of "colorant dispersion BK2".

(Preparation of Toner Particles 21M-28M and Comparison 21M-25M)

Toner particles 21M-28M and comparison 21M-comparison 25M were prepared according to the same procedure as the preparation method of above toner particles 21BK-28BK and comparison 21BK-comparison 25BK, except that "colorant dispersion 2M" was utilized instead of "colorant dispersion BK2".

(Preparation of Toner Particles 21C-28C and Comparison 21C-25C)

Toner particles 21M-28M and comparison 21M-comparison 25M were prepared according to the same procedure as the preparation method of above toner particles 21BK-28BK and comparison 21BK-comparison 25BK, except that "colorant dispersion 2C" was utilized instead of "colorant dispersion BK2".

The results such as a median diameter by number D50 and a CV value of a particle diameter distribution by number, of toners prepared in such a manner described above are shown in Tables 1-4.

TABLE 1

| Toner Particles | Releasing Agent | Number-based D50 (μm) | CV Value | Toner Particles | Releasing Agent | Number-based D50 (μm) | CV Value |
|---|---|---|---|---|---|---|---|
| 11Bk | Stearyl Stearate | 3.0 | 18.1 | 11Y | Stearyl Stearate | 3.1 | 18.2 |
| 12Bk | Stearyl Stearate | 3.5 | 20.0 | 12Y | Stearyl Stearate | 3.6 | 20.0 |
| 13Bk | Stearyl Stearate | 4.0 | 18.0 | 13Y | Stearyl Stearate | 4.1 | 18.6 |
| 14Bk | Stearyl Stearate | 5.0 | 20.0 | 14Y | Stearyl Stearate | 4.9 | 20.0 |
| 15Bk | Stearyl Stearate | 3.8 | 15.4 | 15Y | Stearyl Stearate | 3.7 | 15.4 |
| 16Bk | Stearyl Stearate | 3.5 | 12.1 | 16Y | Stearyl Stearate | 3.4 | 12.1 |
| 17Bk | Myristyl Myristate | 4.0 | 14.8 | 17Y | Myristyl Myristate | 4.1 | 14.6 |
| 18Bk | Behenyl behenate | 3.8 | 15.2 | 18Y | Behenyl behenate | 3.8 | 15.8 |
| Comp 11Bk | Stearyl Stearate | 2.5 | 20.0 | Comp 11Y | Stearyl Stearate | 2.4 | 20.0 |
| Comp 12Bk | Stearyl Stearate | 5.5 | 19.6 | Comp 12Y | Stearyl Stearate | 5.7 | 19.1 |
| Comp 13Bk | Stearyl Stearate | 5.0 | 25.1 | Comp 13Y | Stearyl Stearate | 5.0 | 25.6 |
| Comp 14Bk | Distyryl Ketone | 4.5 | 18.2 | Comp 14Y | Distyryl Ketone | 4.5 | 19.5 |
| Comp 15Bk | Behenyl behenate | 7.5 | 25.4 | Comp 15Y | Behenyl behenate | 7.7 | 28.1 |

TABLE 2

| Toner Particles | Releasing Agent | Number-based D50 (μm) | CV Value | Toner Particles | Releasing Agent | Number-based D50 (μm) | CV Value |
|---|---|---|---|---|---|---|---|
| 11M | Stearyl Stearate | 3.2 | 18.1 | 11C | Stearyl Stearate | 3.1 | 18.2 |
| 12M | Stearyl Stearate | 3.4 | 20.0 | 12C | Stearyl Stearate | 3.6 | 20.0 |
| 13M | Stearyl Stearate | 4.2 | 17.6 | 13C | Stearyl Stearate | 4.1 | 18.4 |
| 14M | Stearyl Stearate | 4.9 | 20.0 | 14C | Stearyl Stearate | 4.8 | 19.6 |
| 15M | Stearyl Stearate | 3.7 | 15.6 | 15C | Stearyl Stearate | 3.7 | 15.1 |
| 16M | Stearyl Stearate | 3.5 | 13.4 | 16C | Stearyl Stearate | 3.4 | 12.6 |
| 17M | Myristyl Myristate | 4.0 | 14.3 | 17C | Myristyl Myristate | 4.1 | 15.1 |
| 18M | Behenyl behenate | 3.8 | 15.7 | 18C | Behenyl behenate | 3.7 | 14.7 |
| Comp. 11M | Stearyl Stearate | 2.5 | 20.0 | Comp. 11C | Stearyl Stearate | 2.4 | 20.0 |
| Comp. 12M | Stearyl Stearate | 5.5 | 19.8 | Comp. 12C | Stearyl Stearate | 5.7 | 19.6 |
| Comp. 13M | Stearyl Stearate | 5.0 | 25.6 | Comp. 13C | Stearyl Stearate | 5.3 | 27.0 |
| Comp. 14M | Distyryl Ketone | 4.6 | 18.0 | Comp. 14C | Distyryl Ketone | 4.5 | 19.1 |
| Comp. 15M | Behenyl behenate | 7.8 | 25.6 | Comp. 15C | Behenyl behenate | 7.7 | 28.8 |

TABLE 3

| Toner Particles | Releasing Agent | Number-based D50 (μm) | CV Value | Toner Particles | Releasing Agent | Number-based D50 (μm) | CV Value |
|---|---|---|---|---|---|---|---|
| 21Bk | Behenyl behenate | 3.1 | 19.7 | 21Y | Behenyl behenate | 3.1 | 19.0 |
| 22Bk | Behenyl behenate | 3.6 | 12.1 | 22Y | Behenyl behenate | 3.6 | 12.9 |
| 23Bk | Behenyl behenate | 4.0 | 16.6 | 23Y | Behenyl behenate | 4.0 | 16.8 |
| 24Bk | Behenyl behenate | 5.0 | 20.0 | 24Y | Behenyl behenate | 5.0 | 20.0 |
| 25Bk | Behenyl behenate | 4.5 | 14.5 | 25Y | Behenyl behenate | 4.5 | 14.5 |
| 26Bk | Behenyl behenate | 3.8 | 14.7 | 26Y | Behenyl behenate | 3.8 | 14.1 |
| 27Bk | Myristyl Myristate | 3.9 | 13.1 | 27Y | Myristyl Myristate | 3.9 | 13.2 |
| 28Bk | Stearyl Stearate | 3.7 | 14.7 | 28Y | Stearyl Stearate | 3.7 | 14.6 |
| Comp. 21Bk | Behenyl behenate | 2.5 | 20.0 | Comp.21Y | Behenyl behenate | 2.5 | 20.0 |
| Comp. 22Bk | Behenyl behenate | 7.0 | 19.7 | Comp.22Y | Behenyl behenate | 7.0 | 19.0 |
| Comp. 23Bk | Behenyl behenate | 5.0 | 28.1 | Comp.23Y | Behenyl behenate | 5.0 | 28.9 |
| Comp. 24Bk | Behenyl behenate | 7.9 | 29.2 | Comp.24Y | Behenyl behenate | 7.9 | 29.0 |
| Comp. 25Bk | Paraffin Wax | 4.4 | 20.0 | Comp.25Y | Paraffin Wax | 4.4 | 20.0 |

TABLE 4

| Toner Particles | Releasing Agent | Number-based D50 (μm) | CV Value | Toner Particles | Releasing Agent | Number-based D50 (μm) | CV Value |
|---|---|---|---|---|---|---|---|
| 21M | Behenyl behenate | 3.1 | 19.1 | 21C | Behenyl behenate | 3.1 | 19.1 |
| 22M | Behenyl behenate | 3.6 | 12.1 | 22C | Behenyl behenate | 3.6 | 12.5 |
| 23M | Behenyl behenate | 4.0 | 17.4 | 23C | Behenyl behenate | 4.0 | 16.5 |
| 24M | Behenyl behenate | 5.0 | 20.0 | 24C | Behenyl behenate | 5.0 | 20.0 |
| 25M | Behenyl behenate | 4.5 | 14.5 | 25C | Behenyl behenate | 4.5 | 15.0 |
| 26M | Behenyl behenate | 3.8 | 14.6 | 26C | Behenyl behenate | 3.8 | 14.0 |
| 27M | Myristyl Myristate | 3.9 | 13.1 | 27C | Myristyl Myristate | 3.9 | 13.9 |
| 28M | Stearyl Stearate | 3.7 | 14.1 | 28C | Stearyl Stearate | 3.7 | 14.1 |
| Comp. 21M | Behenyl behenate | 2.5 | 20.0 | Comp.21C | Behenyl behenate | 2.5 | 20.0 |
| Comp. 22M | Behenyl behenate | 7.0 | 19.8 | Comp.22C | Behenyl behenate | 7.0 | 19.9 |
| Comp. 23M | Behenyl behenate | 5.0 | 28.7 | Comp.23C | Behenyl behenate | 5.0 | 28.0 |
| Comp. 24M | Behenyl behenate | 7.9 | 29.9 | Comp.24C | Behenyl behenate | 7.9 | 29.0 |
| Comp. 25M | Paraffin Wax | 4.4 | 20.0 | Comp.25C | Paraffin Wax | 4.4 | 20.0 |

[Addition of External Additive]

To each of thus obtained Toner Particles (Bk, Y, M, C) and Comparative Toner Particles (Bk, Y, M, C), 0.8 parts by weight of hydrophobic silica, 1.0 part by weight of hydrophobic titanium oxide were added and mixed for 25 minutes by a 10 L of Henschel mixer at a circumference speed of the rotating wings of 30 m/s. The shape and the diameter of each of the colored particles were not varied by the addition of the external additives.

Production of a Carrier [Production of Ferrite Core Material]

In a wet type ball mill, 18 mole-% of MnO, 4 mole-% of MgO and 78 mole-% of Fe2O3 were crushed and mixed for 2 hours and dried. After that, the dried mixture was provisionally baked at 900° C. for 2 hours, and crushed by a ball mill for 3 hours and made to slurry. The slurry was granulated and dried by a spray dryer after the addition of a dispersing agent and a binder, and then the dried granules were subjected to main baking at 1,200° C. for 3 hours. Thus ferrite core material granules having an electro-resistivity of 4.3×108 W·cm were obtained.

[Preparation of Coating Resin]

First, by an emulsion polymerization method in which concentration in the aqueous solution media using the benzenesulfonic acid sodium having an alkyl group of a carbon atoms 12 as a surfactant was made into 0.3 weight %, a copolymer of cyclo hexyl methacrylate/methyl methacrylate (copolymerization ratios 5/5) was synthesized, resin fine particles having a volume average diameter of the primary particles of 0.1 μm, a weight average molecular weight (Mw) of 200,000, a number average molecular weight (Mn) of 91,000, an Mw/Mn ratio of 2.2, a softening point (Tsp) of 230° C. and a glass transition point (Tg) of 110° C. were obtained. Incidentally, in the emulsification state, the above-mentioned resin fine particles were on azeotropy with water and the amount of residual monomers was 510 ppm.

Into a high speed stirring mixer having stirring wings, 100 parts by weight of the ferrite core granule and 2 parts by weight of the above-described resin fine particle were put and stirred for 30 minutes at 120° C. so as to be obtain resin coated carrier having a volume average particle diameter of 61 μm by utilizing the effects of the mechanical impact.

Preparation of Developer

Each of Toner Particles 11 through 18, 21 through 28 and Comparative Toner Particles in which the external additives were added, was mixed with the above carrier to prepare developers of each color having a toner concentration of 6% by weight. The developers of each color were combined as shown in Table 3 so as to make Developer Sets 1 trough 18, 21 trough 28 and Comparative Developer Sets 11 through 15, 21 through 25. The structures of each developer set are shown in Table 5.

TABLE 5

| Developing Agent Set No. | Toner Particles | | | |
|---|---|---|---|---|
| | Black (BK) | Yellow (Y) | Magenta (M) | Cyan (C) |
| Developing Agent Set 11 | 11Bk | 11Y | 11M | 11C |
| Developing Agent Set 12 | 12Bk | 12Y | 12M | 12C |
| Developing Agent Set 13 | 13Bk | 13Y | 13M | 13C |
| Developing Agent Set 14 | 14Bk | 14Y | 14M | 14C |
| Developing Agent Set 15 | 15Bk | 15Y | 15M | 15C |
| Developing Agent Set 16 | 16Bk | 16Y | 16M | 16C |
| Developing Agent Set 17 | 17Bk | 17Y | 17M | 17C |
| Developing Agent Set 18 | 18M | 18Y | 18M | 18Bk |
| Developing Agent Set 21 | 21Bk | 21Y | 21M | 21C |
| Developing Agent Set 22 | 22Bk | 22Y | 22M | 22C |
| Developing Agent Set 23 | 23Bk | 23Y | 23M | 23C |
| Developing Agent Set 24 | 24Bk | 24Y | 24M | 24C |
| Developing Agent Set 25 | 25Bk | 25Y | 25M | 25C |
| Developing Agent Set 26 | 26Bk | 26Y | 26M | 26C |
| Developing Agent Set 27 | 27Bk | 27Y | 27M | 27C |
| Developing Agent Set 28 | 28Bk | 28Y | 28M | 28C |
| Comp. Developing Agent Set 11 | Comp. 11Bk | Comp. 11Y | Comp. 11M | Comp. 11C |
| Comp. Developing Agent Set 12 | Comp. 12Bk | Comp. 12Y | Comp. 12M | Comp. 12C |
| Comp. Developing Agent Set 13 | Comp. 13Bk | Comp. 13Y | Comp. 13M | Comp. 13C |
| Comp. Developing Agent Set 14 | Comp. 14Bk | Comp. 14Y | Comp. 14M | Comp. 14C |
| Comp. Developing Agent Set 15 | Comp. 15Bk | Comp. 15Y | Comp. 15M | Comp. 15C |
| Comp. Developing Agent Set 21 | Comp. 21Bk | Comp. 21Y | Comp. 21M | Comp. 21C |
| Comp. Developing Agent Set 22 | Comp. 22Bk | Comp. 22Y | Comp. 22M | Comp. 22C |
| Comp. Developing Agent Set 23 | Comp. 23Bk | Comp. 23Y | Comp. 23M | Comp. 23C |
| Comp. Developing Agent Set 24 | Comp. 24Bk | Comp. 24Y | Comp. 24M | Comp. 24C |
| Comp. Developing Agent Set 25 | Comp. 25Bk | Comp. 25Y | Comp. 25M | Comp. 25C |

Image forming experiments were carried out employing the above-described developers and the full color image forming apparatus shown in FIG. 2.

The ultrasonic waves to be applied to the photoreceptor and the image receiving material were generated by the following conditions.

Conditions of the Ultrasonic Wave Generating Apparatus

Distance L2 between the ultrasonic waves irradiating face to the face facing to the irradiating face: 4.25 mm Resonance frequency of the ultrasonic wave generation element: 40 kHz Output electric power: 5 W The fixing was carried out by the method employing the heating roller set at 165° C. and at a line speed of 420 mm/sec.

Under the above conditions, 100,000 sheets of image formation were carried out. The same evaluations were performed about image formation under a low temperature and low humidity condition at 10° C. and 20% RH, referred to as LL, and a high temperature and high humidity condition at 30° C. and 85% RH, referred to as HH; the fluctuation of the image formation is considerably expanded under such the conditions.

Concrete evaluation items were as follows.

Evaluation of Transfer Ability

[Transfer Efficiency]

The color difference between the first printed image and the 100,000th print image was evaluated as the indicator of the variation of the transfer efficiency. The color difference was evaluated by the following procedure. Concretely, the colors of the solid image of secondary colors (red, green and blue) formed on the first and 100,000th images each printed under the both of the conditions were measured by Macbeth Color-eye 7000 and the color difference was calculated by CMC (2:1) color difference equation.

When the color deference calculated by the CMC (2:1) color difference formula is not more than 5, it was judged that the variation of the color of the formed images was within the acceptable range and the good transfer efficient was maintained.

[Deformation of Image]

For evaluation of the image deformation, the image deformation on the occasion of the transfer and that on the occasion of the fixing were evaluated about the resolution or file line reproducibility of the line image formed by dots of four colors. The line image was formed in the direction crossing to the direction of the development of the image forming apparatus, the resolution represented by line/mm was evaluated according to the distinguish ability of the fine lines by the observation through a loupe having a magnitude of 10 times.

In the evaluation of the resolution, situation of the occurrence of scattering around the image was evaluated together with. The observation results of the scattering were classified into the following four ranks.

A: No scattering was observed around the image even when the image was observed through the loupe.

B: The scattering around the image was observed by the loupe but the scattering was not observed by human eyes.

C: The scattering around the line was observed.

D: The scattering was considerably occurred so that the lines were indistinguishable.

Fixable Evaluation

[Anti-offset Ability]

After printing of 100,000 sheets, white paper was printed and the situation of the contamination caused by the offset and that of the surface of the heating roller by the toner were visually evaluated. For the evaluation, thick high quality paper with a weight of 200 g/m2 was employed and a line image having a width of 0.3 mm and a length of 150 mm was formed in the direction the same as the progressing direction of the paper.

A: Both of the offset image on the white paper and the toner contamination on the heating roller were entirely not observed.

B: Though any offset image on the white paper is not confirmed, the toner contamination of the heating roller was observed.

C: The offset image was confirmed on the white paper.

The evaluation ranks A and B was acceptable and rank C was unacceptable for practical use.

[Occurrence of Jamming by Winding]

After printing of 100,000 sheets of image, the line speed was changed from 420 mm/sec to 840 mm/sec while the temperature of the heating roller was maintained at 165° C., and the image formation was performed to evaluate the winding of the paper.

A: Any jamming caused by fault of separation from the fixing roller and any mark of the claw were not observed.

B: Though any jamming by fault of the separation from the fixing roller did not occur, the claw marks were observed some degree (no problem in the practical use).

[Filming on the Photoreceptor]

The surface of the photoreceptor was visually observed after printing of 500,000 sheets to judge the presence of the filming.

[Uniformity of Halftone Image]

Degradation of the uniformity of the halftone image accompanied with the variation of the transferring ability caused by the occurrence of the filming was evaluated. The norm of the evaluation was as follows.

Rank A: The image was uniform without unevenness.

Rank B: Although a streak-like thin unevenness existed, there was no problem practically.

Rank C: Although several lines of streak-like unevenness were observed, there was no problem practically.

Rank D: Presence of 5 or more obvious unevenness lines was confirmed.

Evaluation Results are Listed in Tables 6 and 7.

TABLE 6

| | | (LLEnvironment Evaluation Result) Experiment 1 | | | | | | | | | | |
|---|---|---|---|---|---|---|---|---|---|---|---|---|
| | | Transferring ability | | | | | | | | | | |
| | | | | | Thin Line Reproducibility (lines) | | Occurrence of Scattering | | Fixing Ability | | Evaluation for Filming on Photoreceptor | |
| | Developing Agent Set No. | Color difference | | | Initial Stage | After 100,000 Copies | Initial Stage | After 100,000 Copies | Offset Resistance | Coiling-round Tendency | Occurrence of Filming | Evenness of Halftone |
| | | R | G | B | | | | | | | | |
| Inv. Exam. 1 | *1 11 | 3 | 4 | 5 | 8 | 7 | A | B | B | C | No | B |
| Inv. Exam. 2 | *1 12 | 3 | 3 | 4 | 8 | 8 | A | B | A | B | No | A |
| Inv. Exam. 3 | *1 13 | 2 | 3 | 2 | 8 | 8 | A | A | A | B | No | A |
| Inv. Exam. 4 | *1 14 | 2 | 2 | 3 | 8 | 6 | A | A | A | B | No | A |
| Inv. Exam. 5 | *1 15 | 1 | 1 | 2 | 8 | 8 | A | A | A | A | No | A |
| Inv. Exam. 6 | *1 16 | 1 | 1 | 1 | 8 | 8 | A | A | A | A | No | A |
| Inv. Exam. 7 | *1 17 | 1 | 2 | 1 | 8 | 7 | A | B | A | B | No | A |
| Inv. Exam. 8 | *1 18 | 1 | 1 | 1 | 8 | 7 | A | B | A | A | No | A |
| Inv. Exam. 9 | *1 21 | 5 | 4 | 4 | 8 | 6 | A | B | B | C | No | B |
| Inv. Exam. 10 | *1 22 | 3 | 3 | 3 | 8 | 7 | A | B | A | B | No | A |
| Inv. Exam. 11 | *1 23 | 2 | 3 | 2 | 8 | 8 | A | A | A | B | No | A |
| Inv. Exam. 12 | *1 24 | 4 | 3 | 4 | 8 | 6 | A | B | B | C | No | B |
| Inv. Exam. 13 | *1 25 | 1 | 2 | 1 | 8 | 8 | A | A | A | B | No | A |
| Inv. Exam. 14 | *1 26 | 1 | 1 | 1 | 8 | 8 | A | A | A | A | No | A |
| Inv. Exam. 15 | *1 27 | 3 | 2 | 3 | 8 | 7 | A | B | A | B | No | A |
| Inv. Exam. 16 | *1 28 | 2 | 1 | 1 | 8 | 8 | A | A | A | A | No | A |
| Comp. Exam. 1 | *2 11 | 4 | 5 | 5 | 8 | 7 | A | C | B | D | Yes | B |
| Comp. Exam. 2 | *2 12 | 9 | 8 | 8 | 6 | 4 | B | D | D | C | Yes | C |
| Comp. Exam. 3 | *2 13 | 5 | 6 | 5 | 7 | 6 | B | C | D | C | Yes | C |
| Comp. Exam. 4 | *2 14 | 8 | 8 | 9 | 6 | 4 | C | D | D | D | Yes | D |
| Comp. Exam. 5 | *2 15 | 4 | 3 | 5 | 7 | 5 | B | C | D | D | Yes | C |
| Comp. Exam. 6 | *2 21 | 6 | 7 | 7 | 8 | 6 | A | B | D | D | Yes | B |
| Comp. Exam. 7 | *2 22 | 6 | 7 | 6 | 6 | 4 | B | C | B | C | Yes | C |
| Comp. Exam. 8 | *2 23 | 4 | 6 | 4 | 7 | 4 | B | B | B | D | Yes | C |
| Comp. Exam. 9 | *2 24 | 8 | 9 | 8 | 6 | 4 | C | D | D | D | Yes | D |
| Comp. Exam. 10 | *2 25 | 7 | 6 | 7 | 7 | 6 | B | C | D | D | No | C |

*1; Developing Agent Set

*2; Com. Developing Agent Set

TABLE 7

(HHEnvironment Evaluation Result) Experiment 1

| | Developing Agent Set No. | Color difference R | G | B | Transferring ability: Thin Line Reproducibility (lines) Initial Stage | After 100,000 Copies | Occurrence of Scattering Initial Stage | After 100,000 Copies | Fixing Ability: Offset Resistance | Coiling-round Tendency | Evaluation for Filming on Photoreceptor: Occurrence of Filming | Evenness of Halftone |
|---|---|---|---|---|---|---|---|---|---|---|---|---|
| Inv. Exam. 17 | *1 11 | 4 | 4 | 4 | 7 | 7 | B | B | B | C | No | B |
| Inv. Exam. 18 | *1 12 | 4 | 3 | 4 | 8 | 7 | A | B | A | B | No | B |
| Inv. Exam. 19 | *1 13 | 3 | 3 | 2 | 8 | 8 | A | A | A | B | No | A |
| Inv. Exam. 20 | *1 14 | 3 | 3 | 3 | 8 | 7 | A | A | A | B | No | B |
| Inv. Exam. 21 | *1 15 | 1 | 2 | 2 | 8 | 8 | A | A | A | B | No | A |
| Inv. Exam. 22 | *1 16 | 1 | 1 | 1 | 8 | 8 | A | A | A | B | No | A |
| Inv. Exam. 23 | *1 17 | 1 | 2 | 3 | 8 | 7 | A | B | A | B | No | B |
| Inv. Exam. 24 | *1 18 | 4 | 4 | 4 | 7 | 7 | A | B | B | C | No | B |
| Inv. Exam. 25 | *1 21 | 5 | 4 | 4 | 7 | 7 | B | B | A | C | No | B |
| Inv. Exam. 26 | *1 22 | 3 | 4 | 4 | 8 | 7 | A | B | A | B | No | B |
| Inv. Exam. 27 | *1 23 | 3 | 3 | 2 | 8 | 8 | A | A | A | B | No | A |
| Inv. Exam. 28 | *1 24 | 3 | 3 | 3 | 8 | 7 | A | A | A | B | No | B |
| Inv. Exam. 29 | *1 25 | 1 | 2 | 1 | 8 | 8 | A | A | A | B | No | A |
| Inv. Exam. 30 | *1 26 | 1 | 1 | 1 | 8 | 8 | A | A | A | B | No | A |
| Inv. Exam. 31 | *1 27 | 2 | 2 | 3 | 8 | 7 | A | A | A | B | No | A |
| Inv. Exam. 32 | *1 28 | 4 | 4 | 4 | 7 | 7 | A | B | B | C | No | B |
| Comp. Exam. 11 | *2 11 | 4 | 5 | 6 | 7 | 5 | B | C | B | D | Yes | C |
| Comp. Exam. 12 | *2 12 | 5 | 6 | 5 | 8 | 4 | B | C | D | D | Yes | D |
| Comp. Exam. 13 | *2 13 | 7 | 6 | 5 | 7 | 4 | B | D | D | D | Yes | C |
| Comp. Exam. 14 | *2 14 | 8 | 8 | 9 | 6 | 4 | B | D | D | D | Yes | D |
| Comp. Exam. 15 | *2 15 | 8 | 7 | 8 | 7 | 4 | B | C | D | D | Yes | C |
| Comp. Exam. 16 | *2 21 | 5 | 5 | 6 | 8 | 6 | A | C | B | D | Yes | B |
| Comp. Exam. 17 | *2 22 | 6 | 5 | 6 | 6 | 4 | B | C | B | D | Yes | C |
| Comp. Exam. 18 | *2 23 | 4 | 5 | 7 | 7 | 4 | B | C | D | D | Yes | C |
| Comp. Exam. 19 | *2 24 | 8 | 9 | 9 | 6 | 4 | B | D | D | D | Yes | D |
| Comp. Exam. 20 | *2 25 | 8 | 8 | 8 | 7 | 4 | B | D | D | D | No | C |

*1; Developing Agent Set
*2; Com. Developing Agent Set

Experiment 2

Moreover, image formation experiments were carried out employing the foregoing developers and the image forming apparatus shown in FIG. 3.

The conditions of the transfer and the fixing were the same as those in Experiment 1.

The results are shown in Tables 8 and 9.

TABLE 8

(LLEnvironment Evaluation Result) Experiment 2

| | Developing Agent Set No. | Color difference R | G | B | Transferring ability: Thin Line Reproducibility (lines) Initial Stage | After 100,000 Copies | Occurrence of Scattering Initial Stage | After 100,000 Copies | Fixing Ability: Offset Resistance | Coiling-round Tendency | Evaluation for Filming on Photoreceptor: Occurrence of Filming | Evenness of Halftone |
|---|---|---|---|---|---|---|---|---|---|---|---|---|
| Inv. Exam. 33 | *1 11 | 3 | 4 | 4 | 8 | 7 | B | B | B | C | No | B |
| Inv. Exam. 34 | *1 12 | 3 | 3 | 4 | 8 | 8 | A | B | B | B | No | A |
| Inv. Exam. 35 | *1 13 | 2 | 3 | 2 | 8 | 8 | A | A | A | B | No | A |
| Inv. Exam. 36 | *1 14 | 3 | 3 | 3 | 8 | 8 | A | A | B | B | No | A |
| Inv. Exam. 37 | *1 15 | 1 | 2 | 1 | 8 | 8 | A | A | A | B | No | A |
| Inv. Exam. 38 | *1 16 | 1 | 1 | 1 | 8 | 8 | A | A | A | B | No | A |
| Inv. Exam. 39 | *1 17 | 1 | 2 | 2 | 8 | 7 | A | B | A | B | No | A |
| Inv. Exam. 40 | *1 18 | 3 | 4 | 4 | 8 | 7 | A | B | B | C | No | B |
| Inv. Exam. 41 | *1 21 | 3 | 3 | 4 | 8 | 7 | B | B | A | C | No | B |
| Inv. Exam. 42 | *1 22 | 3 | 2 | 3 | 8 | 7 | A | B | A | B | No | A |
| Inv. Exam. 43 | *1 23 | 2 | 3 | 2 | 8 | 8 | A | A | A | B | No | A |

TABLE 8-continued (LLEnvironment Evaluation Result) Experiment 2

| | Developing Agent Set No. | Transferring ability: Color difference R | G | B | Thin Line Reproducibility (lines): Initial Stage | After 100,000 Copies | Occurrence of Scattering: Initial Stage | After 100,000 Copies | Fixing Ability: Offset Resistance | Coiling-round Tendency | Evaluation for Filming on Photoreceptor: Occurrence of Filming | Evenness of Halftone |
|---|---|---|---|---|---|---|---|---|---|---|---|---|
| Inv. Exam. 44 | *1 24 | 4 | 3 | 3 | 8 | 8 | A | A | B | B | No | A |
| Inv. Exam. 45 | *1 25 | 1 | 2 | 1 | 8 | 8 | A | A | A | B | No | A |
| Inv. Exam. 46 | *1 26 | 1 | 1 | 1 | 8 | 8 | A | A | A | B | No | A |
| Inv. Exam. 47 | *1 27 | 2 | 2 | 2 | 8 | 8 | A | A | A | B | No | A |
| Inv. Exam. 48 | *1 28 | 4 | 4 | 3 | 8 | 7 | A | B | B | C | No | B |
| Comp. Exam. 21 | *2 11 | 4 | 6 | 5 | 8 | 5 | A | C | B | D | No | C |
| Comp. Exam. 22 | *2 12 | 5 | 6 | 6 | 6 | 4 | B | D | B | D | Yes | D |
| Comp. Exam. 23 | *2 13 | 5 | 4 | 6 | 8 | 5 | A | D | D | C | No | C |
| Comp. Exam. 24 | *2 14 | 8 | 8 | 9 | 6 | 4 | B | D | D | D | Yes | D |
| Comp. Exam. 25 | *2 15 | 7 | 6 | 6 | 7 | 5 | B | C | D | D | Yes | D |
| Comp. Exam. 26 | *2 21 | 5 | 4 | 5 | 8 | 6 | B | D | D | D | Yes | C |
| Comp. Exam. 27 | *2 22 | 5 | 6 | 5 | 6 | 4 | B | C | B | D | Yes | C |
| Comp. Exam. 28 | *2 23 | 4 | 5 | 5 | 7 | 5 | B | C | B | D | Yes | C |
| Comp. Exam. 29 | *2 24 | 8 | 8 | 8 | 6 | 4 | B | D | D | D | Yes | D |
| Comp. Exam. 30 | *2 25 | 6 | 7 | 7 | 7 | 5 | B | C | D | D | Yes | D |

*1; Developing Agent Set
*2; Com. Developing Agent Set

TABLE 9

(HHEnvironment Evaluation Result) Experiment 2

| | Developing Agent Set No. | Transferring ability: Color difference R | G | B | Thin Line Reproducibility (lines): Initial Stage | After 100,000 Copies | Occurrence of Scattering: Initial Stage | After 100,000 Copies | Fixing Ability: Offset Resistance | Coiling-round Tendency | Evaluation for Filming on Photoreceptor: Occurrence of Filming | Evenness of Halftone |
|---|---|---|---|---|---|---|---|---|---|---|---|---|
| Inv. Exam. 49 | *1 11 | 4 | 4 | 5 | 7 | 6 | B | B | C | C | No | B |
| Inv. Exam. 50 | *1 12 | 3 | 4 | 3 | 7 | 7 | A | B | B | B | No | B |
| Inv. Exam. 51 | *1 13 | 3 | 3 | 2 | 8 | 7 | A | A | A | B | No | A |
| Inv. Exam. 52 | *1 14 | 3 | 4 | 3 | 7 | 7 | A | B | C | B | No | B |
| Inv. Exam. 53 | *1 15 | 1 | 2 | 1 | 8 | 8 | A | A | A | B | No | A |
| Inv. Exam. 54 | *1 16 | 1 | 1 | 1 | 8 | 8 | A | A | A | B | No | A |
| Inv. Exam. 55 | *1 17 | 1 | 2 | 2 | 8 | 7 | A | B | A | B | No | A |
| Inv. Exam. 56 | *1 18 | 4 | 4 | 4 | 7 | 6 | A | B | B | C | No | B |
| Inv. Exam. 57 | *1 21 | 4 | 5 | 4 | 7 | 6 | B | B | B | C | No | B |
| Inv. Exam. 58 | *1 22 | 4 | 3 | 3 | 7 | 7 | B | B | B | B | No | B |
| Inv. Exam. 59 | *1 23 | 2 | 3 | 2 | 8 | 8 | A | A | A | B | No | A |
| Inv. Exam. 60 | *1 24 | 4 | 3 | 5 | 7 | 6 | A | B | B | B | No | A |
| Inv. Exam. 61 | *1 25 | 2 | 1 | 1 | 8 | 8 | A | A | A | B | No | A |
| Inv. Exam. 62 | *1 26 | 1 | 1 | 1 | 8 | 8 | A | A | A | B | No | A |
| Inv. Exam. 63 | *1 27 | 3 | 2 | 3 | 8 | 7 | A | A | A | B | No | A |
| Inv. Exam. 64 | *1 28 | 4 | 5 | 4 | 7 | 6 | B | B | B | C | No | B |
| Comp. Exam. 31 | *2 11 | 6 | 7 | 6 | 8 | 5 | B | C | B | C | No | D |
| Comp. Exam. 32 | *2 12 | 6 | 6 | 7 | 6 | 4 | C | D | D | D | Yes | D |
| Comp. Exam. 33 | *2 13 | 6 | 7 | 7 | 7 | 5 | B | C | D | C | Yes | D |
| Comp. Exam. 34 | *2 14 | 8 | 8 | 9 | 6 | 4 | C | D | D | D | Yes | D |
| Comp. Exam. 35 | *2 15 | 7 | 6 | 6 | 7 | 5 | B | D | D | D | Yes | D |
| Comp. Exam. 36 | *2 21 | 5 | 5 | 6 | 8 | 6 | B | C | D | D | Yes | C |
| Comp. Exam. 37 | *2 22 | 6 | 6 | 6 | 6 | 4 | B | C | B | D | Yes | C |
| Comp. Exam. 38 | *2 23 | 5 | 4 | 5 | 6 | 4 | B | C | B | D | Yes | D |
| Comp. Exam. 39 | *2 24 | 9 | 8 | 9 | 6 | 4 | C | D | D | D | Yes | D |
| Comp. Exam. 40 | *2 25 | 7 | 7 | 6 | 7 | 5 | B | D | D | D | Yes | D |

*1; Developing Agent Set
*2; Com. Developing Agent Set

As being clear from Table 6 to Table 9, according to the image forming method of the present invention, it was confirmed that good transfer performance and fixing performance, and filming performance to a photoreceptor are revealed.

That is, as shown in the evaluation results of Table 6-Table 9, in the present invention, it was confirmed that even if image formation having an ultrasonic transfer process was conducted under relentless circumstances such as a circumstance of a low-temperature low-humidity ambient or a circumstance of a high-temperature and high-humidity, a picture image of beautiful full color was formed stably with high image quality without releasing agents detaching itself from toner under the influence of an oscillation from a supersonic wave.

Example B

In the following explanation, all "parts" mean "parts by weight".

Production of Toner Particles 1C-15C (Production of the Cyan Toner 1C-15C)

(Mixing Process)

Some 200 g of toner composite mixed-solutions A dissolving polyester resins were obtained by distributing the following components with a ball mill for 24 hours.

Components

| | |
|---|---|
| Copolymerization polyester resin of bisphenol A propylene oxide adduct/bisphenol A ethylene oxide adduct/ terephthalic acid derivative (Tg 66° C., Tm 106° C.) | 90 parts |
| C. I. pigment blue (15:3) | 5 parts |
| Stearic acid stearyl (melting point of 58° C.) | 5 parts |
| Ethylacetate | 100 parts |

In the mixing process, toner composite mixed-solution B of 200 g in weight was obtained in the same way except that 7 parts of myristic acid myristyl (melting point of 40° C.) were used in place of stearic acid stearyl representing releasing agents, toner composite mixed-solution C of 200 g in weight was obtained by using 6.5 parts of behenic acid behenyl (melting point of 75° C.), toner composite mixed-solution D of 200 g in weight was obtained by using 5.5 parts of distearyl ketone (melting point of 88° C.), and toner composite mixed-solution E of 200 g in weight was obtained by using 7 parts of paraffin wax.

(Dispersive Suspension Process)

Water-based media dissolving carboxymethyl cellulose were obtained by distributing the following components with a ball mill for 24 hours.

Components

| | |
|---|---|
| Calcium carbonate (covered by acrylic-acid-based copolymer) (Brand name: Ruminus manufactured by Maruo Calcium Co. Ltd. | 20 parts |
| Carboxymethyl cellulose (Brand name: Serogen BS-H, manufactured by Dai-Ichi Kogyo Seiyaku Co. Ltd.) | 0.5 parts |
| Ion exchanged water | 119.5 parts |

Water-based media of 240 g in weight thus obtained were adjusted to 25° C., and toner composite mixed-solution A of 200 g in weight was supplied in Ultratalax (manufactured by IKA Co. Ltd.) to which flow type particle image analyzing instrument FPIA (manufactured by Toa Medical Electronics Co., Ltd.) representing a stainless steel container having a capacity of 1 liter is connected as a monitoring apparatus.

The rotary circumferential speed was set to 15 m/s, and stirring was conducted while observing a form and a particle size with the monitoring apparatus.

After stirring for 5 minutes, the stirring was stopped, and 1C of toner composite dispersed suspension was obtained.

During the stirring, the stainless steel container was immersed in chilled water at 15° C. to be cooled from the outside.

Incidentally, the temperature at the time of completion of the dispersive suspension process was set to 26° C., and the temperature fluctuation during the dispersive suspension process was made to be up to 2° C.

In the same way, the rotary circumferential speed was set to one shown in Table 1, and stirring was conducted for 5 minutes to prepare toner composite dispersed suspensions 1C-6C, and the rotary circumferential speed was set to 15 m/sec and the stirring was conducted for the stirring time shown in Table 1 to prepare 7C-11C.

Further, toner composite dispersed suspensions B-E were used in place of toner composite dispersed suspension A in the method of manufacturing toner composite dispersed suspension 1C, to prepare toner composite dispersed suspensions 12C-15C.

(Solvent Elimination Process)

While stirring each toner composite dispersed suspension obtained in the dispersive suspension process, the gas phase on the suspension surface was updated forcibly at constant temperature of 40° C. by a locally ejection device, and after keeping that condition for 17 hours, toner dispersed solution was obtained.

(Washing Dehydration Process)

Some 40 parts of hydrochloric acid of 10 mol/liter was added to 300 parts of toner dispersed solution obtained through the solvent elimination process, and further, washing by ion exchanged water by suction filtration was repeated 4 times, and toner cake was obtained.

(Drying and Sifting Process)

The toner cake obtained through the washing dehydration process was dried by a vacuum dryer, and then, is sifted through 45 μm mesh, and toner particles were obtained.

(External Adding Process)

One part of silica R 972 (manufactured by Japanese Aerosil Company) was mixed with 100 parts of the toner particles obtained through the sifting process by the sample mill, and silica was added.

In this way, cyan toner 1C-15C shown in Table 1 were obtained.

Incidentally, a form and a particle size of toner particles are not changed by adding of silica.

(Preparation of Magenta Toner 1M-15M)

Each toner composite-mixed solution was prepared by using 6 parts of C.I. pigment red (57:1) in place of 5 parts of C.I. pigment blue in the mixing process in manufacture of cyan toner 1C.

Further, in the dispersive suspension process, dispersive suspension was conducted under the same condition as in the case of cyan toner 11C except that the temperature of the water-based medium and toner composite-mixed solution was set to 35° C.

Incidentally, the temperature at the completion of dispersive suspension process was set to 25° C. and the temperature fluctuation during the dispersive suspension process was made to be 10° C. to prepare magenta toner 1M-15M.

(Preparation of Yellow Toner 1Y-15Y)

Each toner composite-mixed solution was prepared by using 5.5 parts of C.I. pigment yellow (180) in place of 5 parts of C.I. pigment blue in the mixing process in manufacture of cyan toner 1C.

Further, in the dispersive suspension process, dispersive suspension was conducted under the same condition as in the case of cyan toner 11C except that the temperature of the water-based medium and toner composite-mixed solution was set to 5° C.

Incidentally, the temperature at the completion of dispersive suspension process was set to 15° C. and the temperature fluctuation during the dispersive suspension process was made to be 10° C. to prepare yellow toner 1Y-15Y.

(Preparation of Black Toner 1Bk-15Bk)

In the mixing process in production of cyan toner 1C, black toner 1Bk-15Bk were manufactured in the same way except that 6.5 parts of carbon black "Regal 330" (manufactured by Cabot Corp.) were used in place of 5 parts of C.I. pigment blue.

The characteristics of the toner particles 1C-15C, 1M-15M, 1Y-15Y and 1Bk-15Bk are shown in Table 10 and Table 11.

TABLE 10

| | Dispersion Suspension Condition | | | | Toner | |
|---|---|---|---|---|---|---|
| | Rotation | | Releasing Agent | | Characteristic | |
| Toner Particles | Peripheral Speed (m/sec) | Stirring Time (Min) | Name of Composition | Melting Point (° C.) | Number-based D50 (μm) | Average Value of Circularity |
| 1C | 15 | 5 | Stearyl Stearate | 58 | 5.0 | 0.975 |
| 2C | 20 | 5 | Stearyl Stearate | 58 | 4.5 | 0.985 |
| 3C | 25 | 5 | Stearyl Stearate | 58 | 3.5 | 0.993 |
| 4C | 30 | 5 | Stearyl Stearate | 58 | 3.1 | 1.000 |
| 5C | 10 | 5 | Stearyl Stearate | 58 | 7.8 | 0.955 |
| 6C | 5 | 5 | Stearyl Stearate | 58 | 9.8 | 0.901 |
| 7C | 15 | 1 | Stearyl Stearate | 58 | 8.3 | 0.902 |
| 8C | 15 | 3 | Stearyl Stearate | 58 | 6.8 | 0.945 |
| 9C | 15 | 7 | Stearyl Stearate | 58 | 4.3 | 0.983 |
| 10C | 15 | 10 | Stearyl Stearate | 58 | 3.7 | 0.995 |
| 11C | 15 | 20 | Stearyl Stearate | 58 | 7.0 | 0.978 |
| 12C | 15 | 5 | Myristyl Myristate | 40 | 4.8 | 0.980 |
| 13C | 15 | 7 | Behenyl behenate | 75 | 4.3 | 0.991 |
| 14C | 15 | 5 | Distyryl Ketone | 88 | 4.9 | 0.976 |
| 15C | 15 | 5 | Paraffin Wax | 89 | 4.9 | 0.977 |
| 1M | 15 | 5 | Stearyl Stearate | 58 | 4.9 | 0.976 |
| 2M | 20 | 5 | Stearyl Stearate | 58 | 4.4 | 0.988 |
| 3M | 25 | 5 | Stearyl Stearate | 58 | 3.6 | 0.994 |
| 4M | 30 | 5 | Stearyl Stearate | 58 | 3.2 | 0.998 |
| 5M | 10 | 5 | Stearyl Stearate | 58 | 8.0 | 0.954 |
| 6M | 5 | 5 | Stearyl Stearate | 58 | 9.9 | 0.895 |
| 7M | 15 | 1 | Stearyl Stearate | 58 | 8.0 | 0.888 |
| 8M | 15 | 3 | Stearyl Stearate | 58 | 6.7 | 0.949 |
| 9M | 15 | 7 | Stearyl Stearate | 58 | 4.2 | 0.988 |
| 10M | 15 | 10 | Stearyl Stearate | 58 | 3.8 | 0.996 |
| 11M | 15 | 20 | Stearyl Stearate | 58 | 7.2 | 0.980 |
| 12M | 15 | 5 | Myristyl Myristate | 40 | 5.0 | 0.996 |
| 13M | 15 | 7 | Behenyl behenate | 75 | 4.5 | 0.989 |
| 14M | 15 | 5 | Distyryl Ketone | 88 | 4.8 | 0.977 |
| 15M | 15 | 5 | Paraffin Wax | 89 | 4.8 | 0.976 |

TABLE 11

| | Dispersion Suspension Condition | | | | Toner | |
|---|---|---|---|---|---|---|
| | Rotation | | Releasing Agent | | Characteristic | |
| Toner Particles | Peripheral Speed (m/sec) | Stirring Time (Min) | Name of Composition | Melting Point (° C.) | Number-based D50 (μm) | Average Value of Circularity |
| 1Y | 15 | 5 | Stearyl Stearate | 58 | 4.8 | 0.975 |
| 2Y | 20 | 5 | Stearyl Stearate | 58 | 4.3 | 0.988 |
| 3Y | 25 | 5 | Stearyl Stearate | 58 | 3.6 | 0.993 |
| 4Y | 30 | 5 | Stearyl Stearate | 58 | 3.0 | 0.999 |
| 5Y | 10 | 5 | Stearyl Stearate | 58 | 7.9 | 0.950 |
| 6Y | 5 | 5 | Stearyl Stearate | 58 | 9.6 | 0.899 |

TABLE 11-continued

| | Dispersion Suspension Condition | | | | Toner | |
|---|---|---|---|---|---|---|
| | Rotation | | Releasing Agent | | Characteristic | |
| Toner Particles | Peripheral Speed (m/sec) | Stirring Time (Min) | Name of Composition | Melting Point (° C.) | Number-based D50 (μm) | Average Value of Circularity |
| 7Y | 15 | 1 | Stearyl Stearate | 58 | 8.5 | 0.900 |
| 8Y | 15 | 3 | Stearyl Stearate | 58 | 6.5 | 0.955 |
| 9Y | 15 | 7 | Stearyl Stearate | 58 | 4.3 | 0.987 |
| 10Y | 15 | 10 | Stearyl Stearate | 58 | 3.5 | 0.995 |
| 11Y | 15 | 20 | Stearyl Stearate | 58 | 7.3 | 0.979 |
| 12Y | 15 | 5 | Myristyl Myristate | 40 | 4.6 | 0.984 |
| 13Y | 15 | 7 | Behenyl behenate | 75 | 4.1 | 0.987 |
| 14Y | 15 | 5 | Distyryl Ketone | 88 | 5.3 | 0.973 |
| 15Y | 15 | 5 | Paraffin Wax | 89 | 5.0 | 0.977 |
| 1Bk | 15 | 5 | Stearyl Stearate | 58 | 4.7 | 0.977 |
| 2Bk | 20 | 5 | Stearyl Stearate | 58 | 4.1 | 0.993 |
| 3Bk | 25 | 5 | Stearyl Stearate | 58 | 3.5 | 0.998 |
| 4Bk | 30 | 5 | Stearyl Stearate | 58 | 3.0 | 0.988 |
| 5Bk | 10 | 5 | Stearyl Stearate | 58 | 7.8 | 0.954 |
| 6Bk | 5 | 5 | Stearyl Stearate | 58 | 10.0 | 0.895 |
| 7Bk | 15 | 1 | Stearyl Stearate | 58 | 8.3 | 0.888 |
| 8Bk | 15 | 3 | Stearyl Stearate | 58 | 6.4 | 0.940 |
| 9Bk | 15 | 7 | Stearyl Stearate | 58 | 4.0 | 0.990 |
| 10Bk | 15 | 10 | Stearyl Stearate | 58 | 3.5 | 0.997 |
| 11Bk | 15 | 20 | Stearyl Stearate | 58 | 7.8 | 0.978 |
| 12Bk | 15 | 5 | Myristyl Myristate | 40 | 4.7 | 0.988 |
| 13Bk | 15 | 7 | Behenyl behenate | 75 | 4.4 | 0.988 |
| 14Bk | 15 | 5 | Distyryl Ketone | 88 | 5.0 | 0.977 |
| 15Bk | 15 | 5 | Paraffin Wax | 89 | 4.8 | 0.976 |

Production of a Carrier (Production of Ferrite Core Material)

Those identical to the aforementioned Example A were used.

Preparation of Developer

Toner particles 1C-15C, 1M-15M, 1Y-15Y and 1Bk-15Bk to which external additives have been added were mixed with the carrier stated above, and developers in respective colors each having toner concentration of 6 weight % were prepared respectively.

Developers with respective colors were combined as shown in Table 12 to prepare developer sets 1-8 and comparative developer sets 1-7.

The structure of each developer set is shown in Table 12.

TABLE 12

| | Toner Particles | | | |
|---|---|---|---|---|
| Developing Agent Set | BK (Black) | Y (Yellow) | M (Magenta) | C (Cyan) |
| Developing Agent Set 1 | 1Bk | 1Y | 1M | 1C |
| Developing Agent Set 2 | 2Bk | 2Y | 2M | 2C |
| Developing Agent Set 3 | 3Bk | 3Y | 3M | 3C |
| Developing Agent Set 4 | 4Bk | 4Y | 4M | 4C |
| Developing Agent Set 5 | 9Bk | 9Y | 9M | 9C |
| Developing Agent Set 6 | 10Bk | 10Y | 10M | 10C |
| Developing Agent Set 7 | 12Bk | 12Y | 12M | 12C |
| Developing Agent Set 8 | 13Bk | 13Y | 13M | 13C |

TABLE 12-continued

| | Toner Particles | | | |
|---|---|---|---|---|
| Developing Agent Set | BK (Black) | Y (Yellow) | M (Magenta) | C (Cyan) |
| Comp. Developing Agent Set 1 | 5Bk | 5Y | 5M | 5C |
| Comp. Developing Agent Set 2 | 6Bk | 6Y | 6M | 6C |
| Comp. Developing Agent Set 3 | 7Bk | 7Y | 7M | 7C |
| Comp. Developing Agent Set 4 | 8Bk | 8Y | 8M | 8C |
| Comp. Developing Agent Set 5 | 11Bk | 11Y | 11M | 11C |
| Comp. Developing Agent Set 6 | 14Bk | 14Y | 14M | 14C |
| Comp. Developing Agent Set 7 | 15Bk | 15Y | 15M | 15C |

Experiment 1

Image forming experiments were carried out employing the above-mentioned developers and the full color image forming apparatus shown in FIG. 1.

Incidentally, conditions for the supersonic wave that is given to a photoreceptor and to a medium used for the transfer were made to be the same as those in Example A.

Under the above conditions, 100,000 sheets were subjected to image forming.

The image forming was conducted under the ambient conditions of high temperature and high humidity (30° C./85% RH) which are regarded to cause great fluctuations in particular.

The same evaluation items as in Example A were used for the evaluation.

Table 13 shows the results.

TABLE 13

| | Developing Agent | Transferring ability: Color difference | | | Thin Line Reproducibility (lines) | | Occurrence of Scattering | | Fixing Ability | | Evaluation for Filming on Photoreceptor | |
|---|---|---|---|---|---|---|---|---|---|---|---|---|
| | Set No. | R | G | B | Initial Stage | After 100,000 Copies | Initial Stage | After 100,000 Copies | Offset Resistance | Coiling-round Tendency | Occurrence of Filming | Evenness of Halftone |
| Inv. Exam. 1 | *1 1 | 3 | 4 | 5 | 8 | 7 | A | B | B | B | No | B |
| Inv. Exam. 2 | *1 2 | 2 | 2 | 1 | 8 | 8 | A | A | A | A | No | A |
| Inv. Exam. 3 | *1 3 | 2 | 1 | 1 | 8 | 8 | A | A | A | A | No | A |
| Inv. Exam. 4 | *1 4 | 3 | 2 | 4 | 8 | 7 | A | A | A | B | No | A |
| Inv. Exam. 5 | *1 5 | 1 | 1 | 2 | 8 | 8 | A | A | B | A | No | A |
| Inv. Exam. 6 | *1 6 | 1 | 0 | 0 | 8 | 8 | A | A | A | A | No | A |
| Inv. Exam. 7 | *1 7 | 3 | 3 | 2 | 8 | 8 | A | A | B | B | No | B |
| Inv. Exam. 8 | *1 8 | 4 | 3 | 3 | 8 | 8 | A | B | B | B | No | B |
| Comp. Exam. 1 | *2 1 | 5 | 6 | 5 | 8 | 5 | A | C | D | C | No | C |
| Comp. Exam. 2 | *2 2 | 9 | 9 | 8 | 7 | 3 | B | D | D | D | Yes | D |
| Comp. Exam. 3 | *2 3 | 7 | 8 | 8 | 7 | 4 | B | D | D | D | Yes | D |
| Comp. Exam. 4 | *2 4 | 6 | 6 | 6 | 8 | 5 | A | C | D | C | No | C |
| Comp. Exam. 5 | *2 5 | 6 | 5 | 6 | 7 | 5 | B | C | D | D | No | C |
| Comp. Exam. 6 | *2 6 | 5 | 6 | 6 | 8 | 4 | B | D | D | D | Yes | D |
| Comp. Exam. 7 | *2 7 | 6 | 7 | 8 | 8 | 5 | B | D | D | D | Yes | C |

*1; Developing Agent Set
*2; Com. Developing Agent Set

Experiment 2 Further, image forming experiments were carried out employing the foregoing developers and the full color image forming apparatus shown in FIG. 3.

Conditions of transfer and of fixing and evaluation items were made to be the same as those in Experiment 1.

Table 14 shows the results.

As is clear from Table 3 and Table 14, it was confirmed that excellent transfer performance, fixing performance and filming property could be realized by the image forming method related to the invention.

Namely, as shown in the results of evaluations indicated on Table 13 and Table 14, it was confirmed that beautiful full

TABLE 14

| | Developing Agent | Transferring ability: Color difference | | | Thin Line Reproducibility (lines) | | Occurrence of Scattering | | Fixing Ability | | Evaluation for Filming on Photoreceptor | |
|---|---|---|---|---|---|---|---|---|---|---|---|---|
| | Set No. | R | G | B | Initial Stage | After 100,000 Copies | Initial Stage | After 100,000 Copies | Offset Resistance | Coiling-round Tendency | Occurrence of Filming | Evenness of Halftone |
| Inv. Exam. 11 | *1 1 | 4 | 4 | 5 | 8 | 7 | A | B | B | B | No | B |
| Inv. Exam. 12 | *1 2 | 2 | 1 | 2 | 8 | 8 | A | A | A | A | No | A |
| Inv. Exam. 13 | *1 3 | 1 | 1 | 1 | 8 | 8 | A | A | A | A | No | A |
| Inv. Exam. 14 | *1 4 | 3 | 2 | 3 | 8 | 7 | A | A | A | B | No | A |
| Inv. Exam. 15 | *1 5 | 1 | 1 | 2 | 8 | 8 | A | A | B | A | No | A |
| Inv. Exam. 16 | *1 6 | 1 | 0 | 0 | 8 | 8 | A | A | A | A | No | A |
| Inv. Exam. 17 | *1 7 | 3 | 3 | 2 | 8 | 8 | A | A | B | B | No | B |
| Inv. Exam. 18 | *1 8 | 4 | 3 | 3 | 8 | 8 | A | B | B | B | No | B |
| Comp. Exam. 11 | *2 1 | 7 | 6 | 7 | 8 | 5 | B | C | D | D | Yes | C |
| Comp. Exam. 12 | *2 2 | 9 | 9 | 10 | 5 | 2 | C | D | D | D | Yes | D |
| Comp. Exam. 13 | *2 3 | 7 | 8 | 9 | 5 | 2 | C | D | D | D | Yes | D |
| Comp. Exam. 14 | *2 4 | 6 | 6 | 6 | 6 | 4 | B | D | D | D | Yes | D |
| Comp. Exam. 15 | *2 5 | 6 | 5 | 7 | 7 | 4 | B | D | D | D | Yes | D |
| Comp. Exam. 16 | *2 6 | 6 | 8 | 6 | 7 | 3 | C | D | D | D | Yes | D |
| Comp. Exam. 17 | *2 7 | 7 | 8 | 8 | 6 | 4 | B | D | D | D | Yes | D |

*1; Developing Agent Set
*2; Com. Developing Agent Set color images with high image quality can be formed stably without the problem that releasing agents are affected by vibrations from supersonic waves to come off from toner, even when the image forming having the supersonic wave transfer process is conducted under the severe conditions such as low temperature and low humidity or high temperature and high humidity in the invention.

What is claimed is:

1. An image forming method comprising the steps of:

developing an electrostatic latent image on a latent image carrier with toner to form a toner image, wherein the toner includes toner particles containing a releasing agent having a melting point of 40-75° C., and has a number-based median diameter D50 of 3.0-5.0 μm and a CV value of 12-20% in a number-based particle size distribution defined by the following equation:

*CV* value (%)=(standard deviation of number particle size distribution/number-based median diameter D50)×100;

transferring the toner image; and utilizing ultrasonic vibrations in the developing step or in the transferring step;

wherein the transferring step comprises a first transferring step of transferring the toner image developed by the developing step to an intermediate transfer member and a second transferring step of transferring the toner image from the intermediate transfer member to a transfer sheet, and the ultrasonic vibrations have a frequency of 40 KHz to 2 MHz and are utilized in at least one of the first and second transferring steps.

2. The image forming method of claim 1, wherein the CV value of the toner is 12-15%.

3. The image forming method of claim 2, wherein the number based median diameter D50 of the toner is 3.5-4.0 μm and the releasing agent having a melting point of 45-75° C.

4. The image forming method of claim 1, wherein the number based median diameter D50 of the toner is 3.5-4.0 μm.

5. The image forming method of claim 1, wherein an addition amount of the releasing agent to toner is 0.5 to 50 mass % based on the toner.

6. The image forming method of claim 1, wherein the releasing agent having a melting point of 45-75° C.

7. The image forming method of claim 1, wherein the releasing agent contains either one or all of behenyl behenate, stearyl stearate, myristyl myristate and distearyl cebacate.

8. The image forming method of claim 1, wherein the ultrasonic vibrations has a frequency of 40 KHz to 2 MHz and used in the developing step.

9. The image forming method of claim 1, wherein the toner is formed by aggregating resin particles containing a releasing agent in a water-based medium.

10. The image forming method of claim 9, wherein the toner is formed in such a manner that a polymerizable monomer, in which a releasing agent is dissolved, is polymerized to form the resin particles and the resin particles are aggregated in a water-based medium.

11. The image forming method of claim 9, wherein the toner is formed by aggregating resin particles and releasing agent particles in a water-based medium.

12. The method of claim 1, wherein when utilizing the ultrasonic vibrations at the transferring step, the ultrasonic vibrations are conducted from of an ultrasonic wave apparatus via a contact member, the contact member being provided between the ultrasonic wave apparatus and at least one of the latent image carrier, the intermediate transfer member and a conveying member which conveys the transfer sheet, wherein the contact member comprises a gel member.

13. An image forming method comprising the steps of:

developing an electrostatic latent image on a latent image carrier with toner to form a toner image, wherein the toner includes toner particles containing a releasing agent having a melting point of 40-75° C., has a mean circularity of 0.975-1.000 and a number-based median diameter D50 of 3.0-5.0 μm;

transferring the toner image; and utilizing ultrasonic vibrations in the developing step or in the transferring step;

wherein the transferring step comprises a first transferring step of transferring the toner image developed by the developing step to an intermediate transfer member and a second transferring step of transferring the toner image from the intermediate transfer member to a transfer sheet, and the ultrasonic vibrations have a frequency of 40 KHz to 2 MHz and are used in at least one of the first and second transferring steps.

14. The image forming method of claim 13, wherein the toner has a CV value of 12-20% in a number-based particle size distribution defined by the following equation:

*CV* value (%)=(standard deviation of number particle size distribution/number-based median diameter D50)×100.

15. The image forming method of claim 13, wherein the number based median diameter D50 of the toner is 3.5 to 4.0 μm.

16. The image forming method of claim 13, wherein an addition amount of the releasing agent to toner 0.5 to 50 mass % based on the toner.

17. The image forming method of claim 13, wherein the releasing agent contains either one or all of behenyl behenate, stearyl stearate, myristyl myristate and distearyl cebacate.

18. The image forming method of claim 13, wherein the ultrasonic vibrations have a frequency of 40 KHz to 2 MHz and used in the developing step.

19. The image forming method of claim 13, wherein the toner particles are obtained through a process in which resin and a colorant are dissolved or dispersed in a solvent, the resulting solution is further dispersed suspended in a water-based medium to form a suspension, and the solvent is removed from said suspension.

20. The method of claim 13, wherein when utilizing the ultrasonic vibrations at the transferring step, the ultrasonic vibrations are conducted from an ultrasonic wave apparatus via a contact member, the contact member contacting being provided between the ultrasonic wave apparatus and at least one of the latent image carrier, the intermediate transfer member and a conveying member which conveys the transfer sheet, and wherein the contact member comprises a gel member.

* * * * *